US009471020B2

(12) United States Patent
Goto et al.

(10) Patent No.: US 9,471,020 B2
(45) Date of Patent: Oct. 18, 2016

(54) IMAGE FORMING APPARATUS AND METHOD FOR ADJUSTING FORMING CONDITION OF IMAGE FORMING APPARATUS

(71) Applicant: Brother Kogyo Kabushiki Kaisha, Nagoya-shi, Aichi-ken (JP)

(72) Inventors: Yuji Goto, Nagoya (JP); Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/667,122

(22) Filed: Mar. 24, 2015

(65) Prior Publication Data

US 2015/0277324 A1 Oct. 1, 2015

(30) Foreign Application Priority Data

Mar. 31, 2014 (JP) ..... 2014-072187

(51) Int. Cl.
*G03G 15/00* (2006.01)
*G03G 15/043* (2006.01)

(52) U.S. Cl.
CPC ..... *G03G 15/5058* (2013.01); *G03G 15/043* (2013.01); *G03G 2215/0141* (2013.01)

(58) Field of Classification Search
CPC combination set(s) only.
See application file for complete search history.

(56) References Cited

U.S. PATENT DOCUMENTS

2011/0052232 A1* 3/2011 Ohshima ..... G03G 15/0131 399/49

FOREIGN PATENT DOCUMENTS

JP 2004-098593 A 4/2004

* cited by examiner

*Primary Examiner* — Minh Phan
(74) *Attorney, Agent, or Firm* — Banner & Witcoff, Ltd.

(57) ABSTRACT

A printer is capable of performing inter-light source adjustment processing for adjusting a forming interval of electrostatic latent images between a first light source and a second light source based on inter-light source adjustment marks, and density adjustment processing for adjusting the density of an image based on a bias adjustment mark, and when the execution conditions of both of inter-light source adjustment and density adjustment are established, performs the inter-light source adjustment processing and then performs the density adjustment processing.

20 Claims, 12 Drawing Sheets

IMAGE FORMING APPARATUS AND METHOD FOR ADJUSTING FORMING CONDITION OF IMAGE FORMING APPARATUS

CROSS-REFERENCE TO RELATED APPLICATION

This application claims priorities from Japanese Patent Application No. 2014-072187 filed on Mar. 31, 2014, the entire subject matter of which is incorporated herein by reference.

TECHNICAL FIELD

The present disclosure relates to a technique in which a plurality of light sources corresponding to one developing unit are provided, electrostatic latent images are formed on a photosensitive member with a plurality of light beams respectively emitted from a plurality of light sources, and the electrostatic latent image is developed by the developing unit.

BACKGROUND

An image forming apparatus which includes a plurality of light sources corresponding to one developing unit, and a multi-beam scanning unit configured to form an electrostatic latent image on a photosensitive member with a plurality of light beams respectively emitted from a plurality of light sources, and develops the electrostatic latent image by the developing unit has been hitherto known. In this image forming apparatus, the electrostatic latent image forming interval which is the interval between the electrostatic latent images formed on the photosensitive member with a plurality of light beams corresponding to one developing unit fluctuates due to optical errors, mechanical errors, fluctuations in optical systems by an increase in temperature, or the like, and image quality may be degraded.

Accordingly, an image forming apparatus which has a function of adjusting the electrostatic latent image forming interval has been hitherto known (see, for example, JP-A-2004-098593). Specifically, this image forming apparatus causes a multi-beam scanning unit to perform an operation to form so-called solid marks with no gap between scanning lines only by light beams from the same light source for each of a plurality of light sources. The image forming apparatus has a sensor which outputs a signal according to the positions of a plurality of marks formed on a photosensitive member, and adjusts the electrostatic latent image forming interval based on the signal from the sensor.

On the other hand, in a case where the electrostatic latent image forming interval is adjusted, the density of an image may be influenced. However, in the related art, studies have not been sufficiently done on the adjustment of the electrostatic latent image forming interval and the influence on the density of an image.

SUMMARY

The present disclosure has been made in view of the above circumstances, and one of objects of the present disclosure is to provide a technique capable of suppressing the influence on the density of an image by the adjustment of an electrostatic latent image forming interval among a plurality of light sources corresponding to one developing unit.

According to an illustrative embodiment of the present invention, there is provided an image forming apparatus including: at least one photosensitive member; a forming unit including at least one developing unit and a multi-beam scanning unit having a plurality of light sources for each developing unit; a sensor; and a controller. The controller is configured to: execute inter-light source adjustment processing to control the forming unit to form, for each of a plurality of light sources, an inter-light source adjustment mark representing a position of an electrostatic latent image formed on the photosensitive member by a light beam from the light source and to adjust a relative electrostatic latent image forming interval among the light sources based on a signal output from the sensor according to the inter-light source adjustment mark; execute density adjustment processing to control the forming unit to form a density mark representing the density of an image formed on the photosensitive member by a plurality of light beams from the light sources and to adjust the density of the image based on a signal output from the sensor according to the density mark; execute condition determination processing to determine whether or not execution conditions of each of the inter-light source adjustment processing and the density adjustment processing are established; execute order determination processing, when determined in the condition determination processing that the execution conditions of both of the inter-light source adjustment processing and the density adjustment processing are established, to determine an execution order so as to perform the inter-light source adjustment processing and thereafter to perform the density adjustment processing.

According to another illustrative embodiment of the present invention, there is provided a method for adjusting a forming condition of an image forming apparatus comprising a photosensitive member, a forming unit that includes at least one developing unit and a multi-beam scanning unit having a plurality of light sources for each developing unit, and a sensor, The method includes: an inter-light source adjustment step for controlling the forming unit to form, for each of a plurality of light sources, an inter-light source adjustment mark representing a position of an electrostatic latent image formed on the photosensitive member by a light beam from the light source and adjusting a relative electrostatic latent image forming interval among the light sources based on a signal output from the sensor according to the inter-light source adjustment mark; a density adjustment step for controlling the forming unit to form a density mark representing the density of an image formed on the photosensitive member by a plurality of light beams from the light sources and adjusting the density of the image based on a signal output from the sensor according to the density mark; a condition determination step for determining whether or not execution conditions of each of the inter-light source adjustment step and the density adjustment step are established; and an order determination step, when determined in the condition determination step that the execution conditions of both of the inter-light source adjustment step and the density adjustment step are established, for determining an execution order so as to perform the inter-light source adjustment step and thereafter to perform the density adjustment step.

According to still another illustrative embodiment of the present invention, there is provided a non-transitory computer-readable storage medium storing instruction to control an image forming apparatus, the image forming apparatus including at least one photosensitive member, a forming unit including at least one developing unit and a multi-beam scanning unit having a plurality of light sources for each developing unit, a sensor, and a controller. The instructions causes the image forming apparatus to perform: an inter-light source adjustment processing for controlling the forming unit to form, for each of a plurality of light sources, an inter-light source adjustment mark representing a position of an electrostatic latent image formed on the photosensitive member by a light beam from the light source and adjusting a relative electrostatic latent image forming interval among the light sources based on a signal output from the sensor according to the inter-light source adjustment mark; a density adjustment processing for controlling the forming unit to form a density mark representing the density of an image formed on the photosensitive member by a plurality of light beams from the light sources and adjusting the density of the image based on a signal output from the sensor according to the density mark; a condition determination processing for determining whether or not execution conditions of each of the inter-light source adjustment processing and the density adjustment processing are established; and an order determination processing, when determined in the condition determination processing that the execution conditions of both of the inter-light source adjustment processing and the density adjustment processing are established, for determining an execution order so as to perform the inter-light source adjustment processing and thereafter to perform the density adjustment processing.

DETAILED DESCRIPTION

Figure 1:
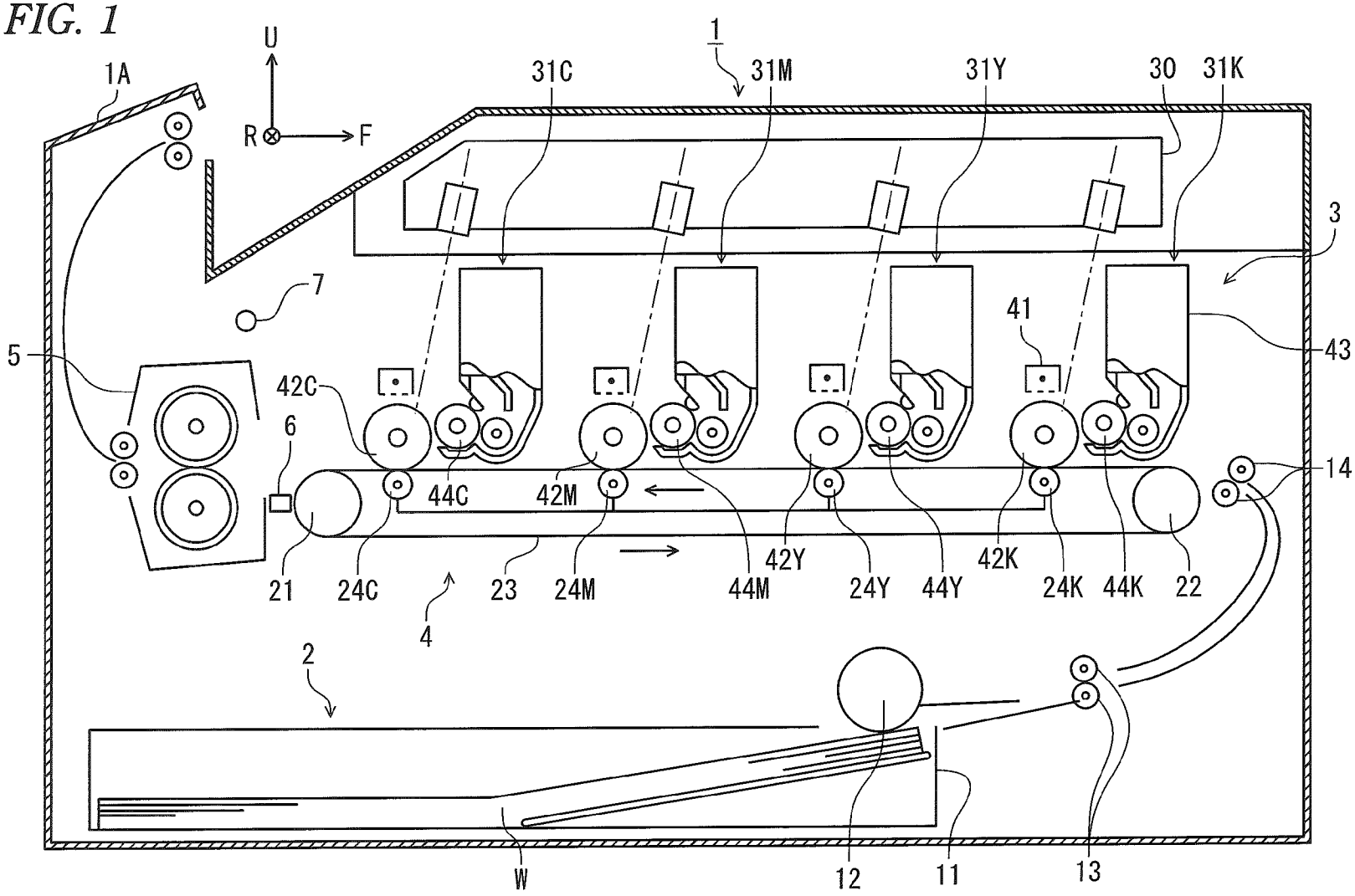
FIG. 1 is a schematic view showing the mechanical configuration of a printer according to an embodiment of the present disclosure.

A printer 1 of an embodiment according to the present disclosure will be described referring to FIGS. 1 to 12. In the following description, the right side on the sheet of FIG. 1 is referred to as the front side F of the printer 1, the deep side on the sheet is referred to as the right side R of the printer 1, and the upper side on the sheet is referred to as the upper side U of the printer 1. The printer 1 is, for example, a direct transfer tandem type color laser printer which is capable to form a color image using toner of four colors of black, yellow, magenta, and cyan. The printer 1 is an example of an image forming apparatus. In the following description, when there is a distinction among components of the printer 1 or terms for each color, K (black), Y (yellow), M (magenta), and C (cyan) meaning the respective colors are attached to the ends of reference numerals of the components and the like. In FIG. 1, reference numerals of the same components among the respective colors are appropriately omitted.

The printer 1 is provided with, inside a body case 1A, a feed unit 2, an image forming unit 3, a conveying mechanism 4, a fixing unit 5, a mark sensor 6, and a humidity sensor 7.

The feed unit 2 has a tray 11 which is provided at the lowest part of the printer 1 and is capable to store a plurality of sheets W, a pickup roller 12, conveying rollers 13, and registration rollers 14. The sheets W stored in the tray 11 are taken one by one by the pickup roller 12, and are fed to the conveying mechanism 4 through the conveying rollers 13 and the registration rollers 14.

The conveying mechanism 4 has a configuration in which a belt 23 is stretched between a driving roller 21 and a driven roller 22. If the driving roller 21 rotates, the surface of the belt 23 opposed to a photosensitive drum 42 moves backward, and the sheet W fed from the registration rollers 14 is conveyed from the image forming unit 3 to the fixing unit 5. Inside the belt 23, four transfer rollers 24K to 24C described below are arranged in the conveying direction of the sheet W, that is, in the front-back direction.

The image forming unit 3 has an exposure unit 30 and four processing units 31K to 31C. The image forming unit 3 and the fixing unit 5 are an example of a forming unit.

Figure 2:
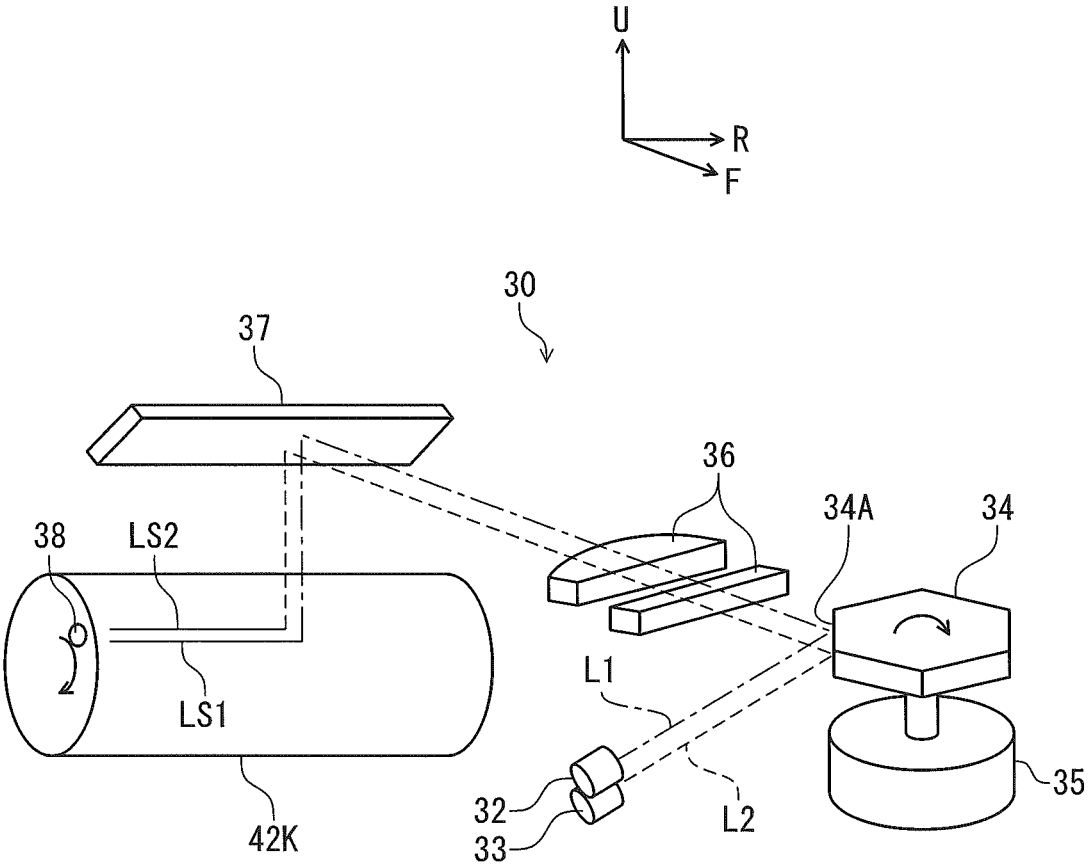
FIG. 2 is a schematic view showing a configuration of an exposure unit.

The exposure unit 30 is an example of a multi-beam scanning unit, and has two light sources for each color to form two scanning lines simultaneously on the photosensitive drum 42 of each color by two light beams respectively emitted from the two light sources. As shown in FIG. 2, the exposure unit 30 has a first light source 32, a second light source 33, a polygon mirror 34, a polygon motor 35, a lens 36, a reflection mirror 37, and a BD sensor 38. Four sets of the first light source 32 and the second light source 33 are provided corresponding to developing rollers 44 of four colors described below.

FIG. 2 illustrates a configuration for exposing a photosensitive drum 42K of black. The polygon mirror 34 is an example of a rotary polygon mirror, and is rotationally driven by the polygon motor 35 to reflect and deflect a light beam L1 from the first light source 32 and a light beam L2 from the second light source 33 by a reflection surface 34A. The photosensitive drum 42K is irradiated with the deflected light beams L1 and L2 through the lens 36 and the reflection mirror 37.

The first light source 32 and the second light source 33 are, for example, laser diodes, and are arranged such that the photosensitive drum 42K is irradiated with the light beams L1 and L2 in a sub scanning direction, in other words, in the rotation direction of the photosensitive drum 42K at an interval. The exposure unit 30 causes at least one of the first light source 32 and the second light source 33 to emit light according to image data corresponding to a print instruction described below, and forms scanning lines on the surface of the photosensitive drum 42K to form an electrostatic latent image. In the drawing, reference numeral LS1 represents a first scanning line formed by the light beam L1, and reference numeral LS2 represents a second scanning line formed by the light beam L2.

The BD sensor 38 is arranged at one end in a main scanning direction with respect to the photosensitive drum 42K and outputs a BD signal according to the presence/absence of the reception of a light beam from one of the first light source 32 and the second light source 33.

The four processing units 31K to 31C are arranged in the conveying direction, that is, in the front-back direction. Hereinafter, the four processing units 31K to 31C have the same configuration except for the color of toner, and a specific configuration will be described with the processing unit 31K corresponding to black as an example.

The processing unit 31K has the transfer roller 24K, a charger 41, a photosensitive drum 42K, a toner box 43, and a developing roller 44K. The photosensitive drum 42K is an example of a photosensitive member, and the developing roller 44K is an example of a developing unit.

The charger 41 charges the surface of the photosensitive drum 42K uniformly. The developing roller 44K supplies toner in the toner box 43 onto the photosensitive drum 42K, develops the electrostatic latent image formed by the exposure unit 30, and forms a toner image of black on the photosensitive drum 42K. The transfer roller 24K is arranged to be opposed to the photosensitive drum 42K through the belt 23 and transfers the toner image formed on the photosensitive drum 42K to the sheet W.

The sheet W with the toner images of the respective colors transferred thereto is conveyed to the fixing unit 5 by the conveying mechanism 4 and is discharged on the top surface of the printer 1 after the toner images are heated and fixed by the fixing unit 5.

The mark sensor 6 is an example of a sensor, is provided on the back side of the belt 23, and outputs a detection signal according to the positions of marks 61 formed on the belt 23, or image density. Specifically, the mark sensor 6 is an optical sensor having a light projection section 6A which emits light toward a detection position E set on the belt 23, and a light reception section 6B which receives reflected light from the detection position E (see FIG. 9). Hereinafter, it is assumed that the mark sensor 6 outputs a detection signal having a higher signal level as the light reception amount is larger. It is assumed that the belt 23 has light reflectance higher than toner, and when no mark is inside a detection area E, the light reception amount of the mark sensor 6 is larger than when a mark is inside the detection area E. It is assumed that the detection area E has a width for a plurality of toner lines described below.

Figure 3:
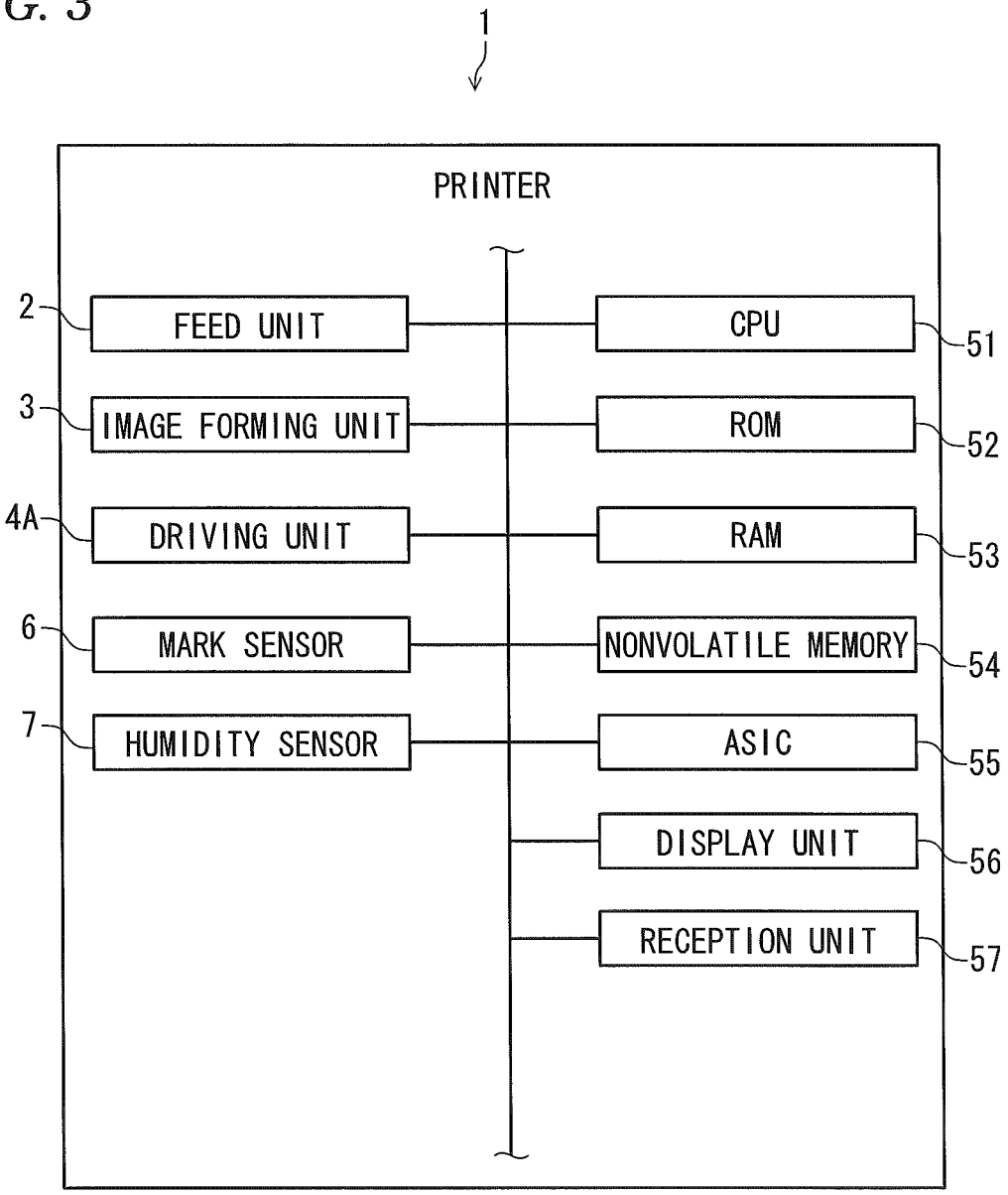
FIG. 3 is a block diagram showing an electrical configuration of the printer.

As shown in FIG. 3, the printer 1 has a driving unit 4A, a central processing unit (hereinafter, referred to as CPU) 51, a ROM 52, a RAM 53, a nonvolatile memory 54, an application specific integrated circuit (ASIC) 55, a display unit 56, and a reception unit 57, in addition to the feed unit 2 and the like.

The driving unit 4A serves to rotate the photosensitive drum 42 and the conveying mechanism 4, and is configured to be capable of changing the rotation speed of the photosensitive drum 42 and the conveying speed of the conveying mechanism 4 under the control of the CPU 51.

The ROM 52 stores various programs, and various programs include, for example, a program for executing control processing described below or a program for controlling the operation of the respective units of the printer 1. The RAM 53 is used as a work area when the CPU 51 executes various programs or a temporary storage area of data. The nonvolatile memory 54 may be a rewritable memory, such as an NVRAM, a flash memory, an HDD, or an EEPROM.

The CPU 51 is an example of a controller. The CPU 51 controls the respective units of the printer 1 according to a program read from the ROM 52. The ASIC 55 is, for example, a hardware circuit configured exclusively for image processing. The display unit 56 has a liquid crystal display, a lamp, or the like and can display various setting screens, the operation state of the apparatus, or the like. The reception unit 57 has a plurality of buttons and is a user interface which receives various input instructions from the user, a communication unit which performs communication with an external apparatus (not shown) by a wireless communication system or a wired communication system, or the like.

The CPU 51 executes light amount adjustment processing, inter-light source adjustment processing, inter-color adjustment processing, and density adjustment processing.

The light amount adjustment processing is processing for adjusting the light emission amount of at least one of the first light source 32 and the second light source 33 such that the difference between the light emission amount of the first light source 32 and the light emission amount of the second light source 33 for each color is eliminated. A light amount adjustment value for adjusting the light emission amount is stored in, for example, the nonvolatile memory 54. The execution conditions of light amount adjustment are, for example, that the number of printed sheets W after the execution of previous light amount adjustment processing reaches a first specified number of sheets and at least one of the execution conditions of inter-light source adjustment described below is established.

That is, when the execution conditions of inter-light source adjustment are established, the execution conditions of light amount adjustment are constantly established; however, even when the execution conditions of light amount adjustment are established, the execution conditions of inter-light source adjustment may not be established. With this, when the execution conditions of inter-light source adjustment are established, constantly, the light amount adjustment processing is performed, and thereafter, the inter-light source adjustment processing is performed. For this reason, the inter-light source adjustment processing is performed in a state where there is the difference in the light emission amount between the light sources 32 and 33, whereby it is possible to suppress degradation in adjustment accuracy of the electrostatic latent image forming interval between the light sources.

The inter-light source adjustment processing is processing for adjusting the exposure start timing of each light source when a light beam of at least one of the first light source 32 and the second light source 33 is written to the photosensitive drum 42 such that the electrostatic latent image forming interval between the light sources which is the interval between the electrostatic latent images formed on the photosensitive drum 42 by the first light source 32 and the second light source 33 becomes a specified interval for each color. A light source adjustment value for adjusting the exposure start timing of each light source is stored in, for example, the nonvolatile memory 54. The execution conditions of inter-light source adjustment are, for example, that the number of printed sheets W after the execution of previous inter-light source adjustment processing reaches a second specified number of sheets larger than the first specified number of sheets. Fluctuation in the electrostatic latent image forming interval includes fluctuation in the main scanning direction and fluctuation in the sub scanning direction. The inter-light source adjustment processing is an example of an inter-light source adjustment process.

The inter-color adjustment processing is processing for adjusting the inter-color exposure time difference which is the time difference between the timing when the exposure unit 30 starts to expose the photosensitive drum 42 of a reference color and the timing when the exposure unit 30 starts to expose the photosensitive drum 42 of an adjustment color such that the mutual shift of the forming positions of the toner images of the respective colors on the sheet W, called a color shift, is eliminated. Hereinafter, the reference color is black, and the adjustment color is yellow, magenta, or cyan. An inter-color adjustment value for adjusting the inter-color exposure time difference is stored in, for example, the nonvolatile memory 54. The execution condition of inter-color adjustment is, for example, that the number of printed sheets W after the execution of previous inter-color adjustment processing reaches a third specified number of sheets less than the first specified number of sheets. The color shift includes a shift in the main scanning direction and a shift in the sub scanning direction.

The density adjustment processing includes bias adjustment processing and gradation adjustment processing. The density adjustment processing is an example of a density adjustment process. The bias adjustment processing is processing for adjusting a developing bias value to the developing roller 44 such that an image with predefined ideal density can be formed for each color. A bias adjustment value for adjusting the developing bias value is stored in, for example, the nonvolatile memory 54. The gradation (gamma) adjustment processing is processing for adjusting the gradation of the density of the toner image formed on the sheet W to an ideal gradation according to the density of an image on image data included in the print instruction for each color. A gradation adjustment value for adjusting the gradation of the density of the toner image is stored in, for example, the nonvolatile memory 54.

The execution conditions of density adjustment are, for example, that the humidity in the body case 1A reaches a specified humidity and at least one of the execution conditions of inter-light source adjustment is established. That is, when the execution conditions of inter-light source adjustment are established, the execution conditions of density adjustment are constantly established; however, even when the execution conditions of density adjustment are established, the execution conditions of inter-light source adjustment may not be established. With this, when the execution conditions of inter-light source adjustment are established, constantly, the inter-light source adjustment processing is performed, and thereafter, the density adjustment processing is performed. For this reason, it is possible to suppress an influence on the density of an image by the adjustment of the electrostatic latent image forming interval among a plurality of light sources corresponding to one developing unit.

Figure 9:
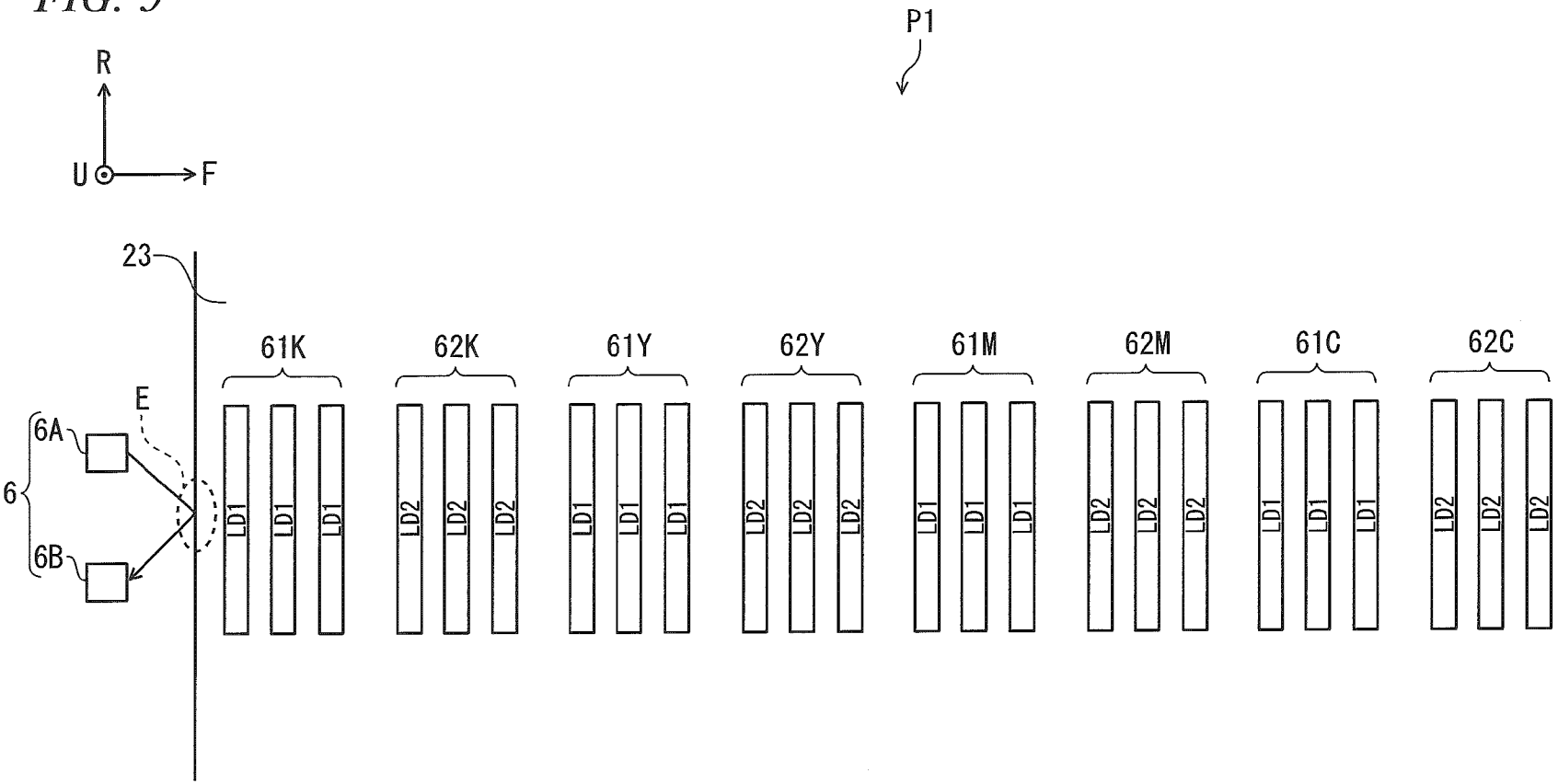
FIG. 9 is a diagram showing an example of an arrangement of a mark sensor and a light amount adjustment pattern.
Figure 10:
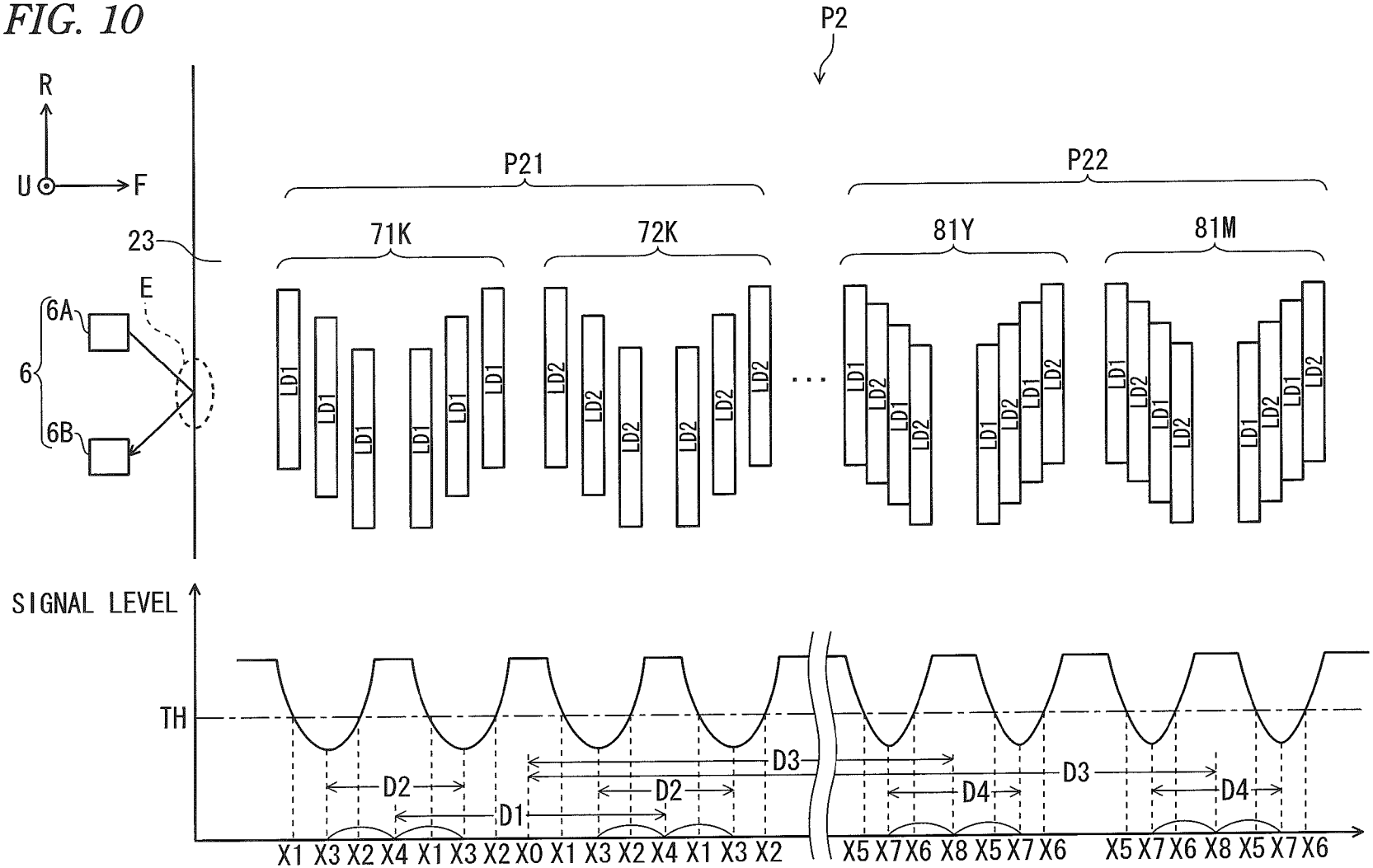
FIG. 10 is a diagram showing an example of an arrangement of a mark sensor and a light source and color adjustment pattern.
Figure 11:
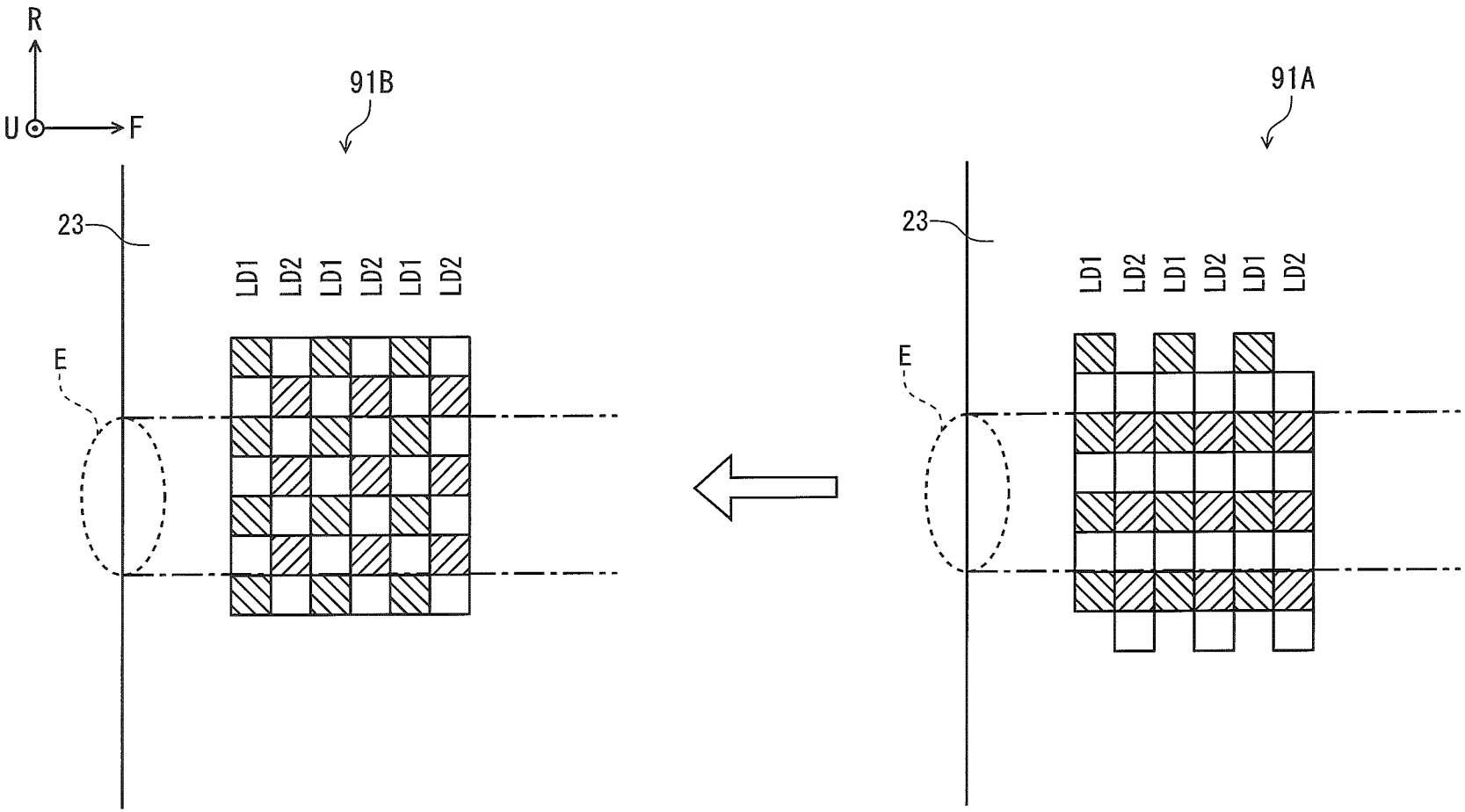
FIG. 11 is a diagram showing an example of a bias adjustment mark.

Details of control executed by the CPU 51 will be described referring to FIGS. 4 to 12. FIGS. 9 to 11 illustrate patterns P1 and P2 and the like described below, lines attached with characters of LD1 represent first toner lines where the first scanning line LS1 is developed, and lines attached with characters of LD2 represent second toner lines where the second scanning line LS2 is developed.

Figure 4:
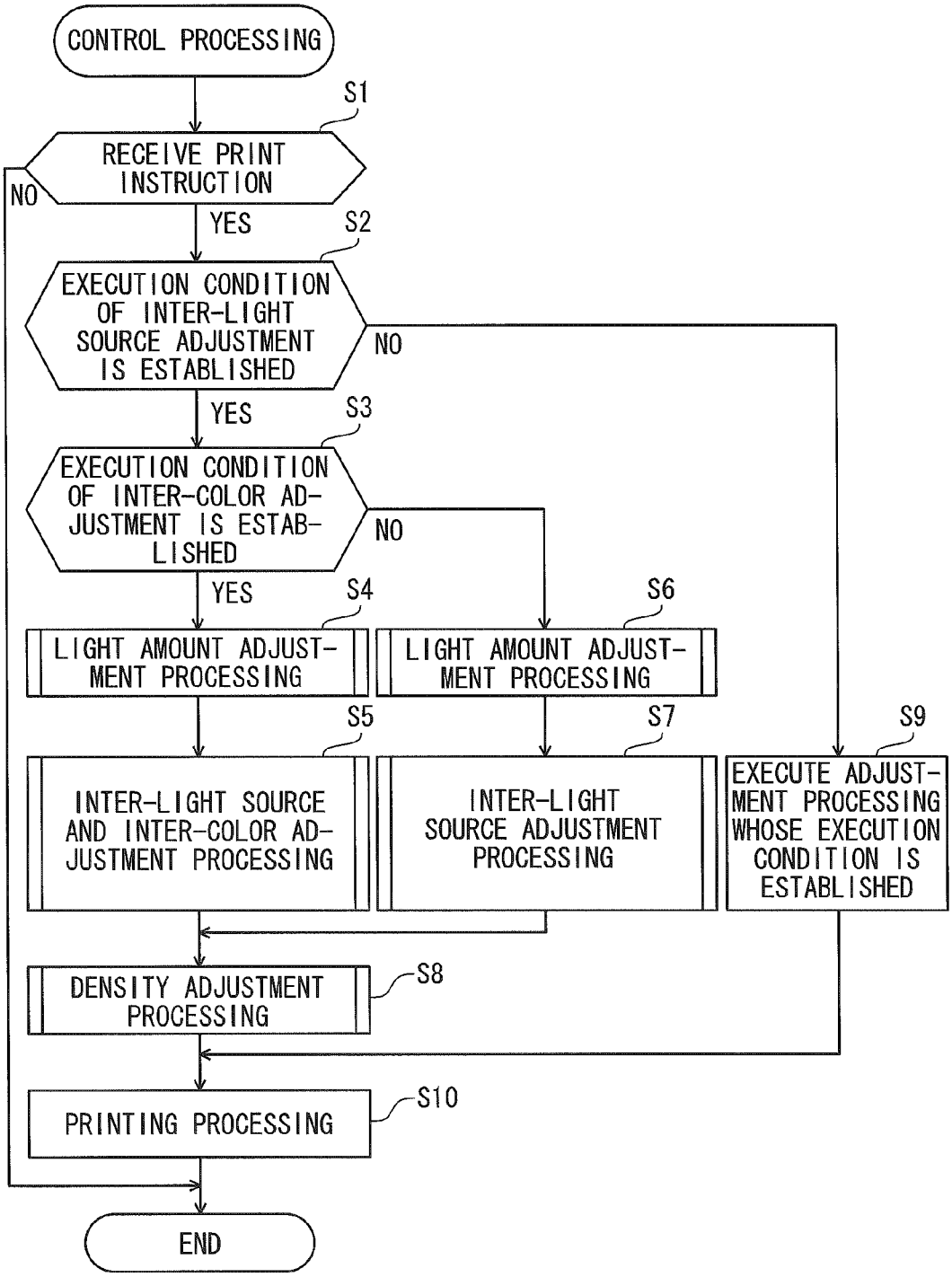
FIG. 4 is a flowchart showing control processing.

For example, when the printer 1 is powered on, the CPU 51 repeatedly executes control processing shown in FIG. 4 at a predetermined time interval. Specifically, the CPU 51 first determines whether or not a print instruction is received from the reception unit 57 (S1), if it is determined that the print instruction is not received (S1: NO), ends the control processing, and starts the control processing again after a predetermined time.

If it is determined that the print instruction is received (S1: YES), the CPU 51 determines whether or not the execution conditions of inter-light source adjustment are established (S2). If it is determined that the execution conditions of inter-light source adjustment are established (S2: YES), the CPU 51 determines whether or not the execution conditions of inter-color adjustment are established (S3). The processing of S2 and S3 is an example of condition determination processing and a condition determination process.

As described above, in this embodiment, when the execution conditions of inter-light source adjustment are established, the execution condition of light amount adjustment and the execution conditions of density adjustment are established. Accordingly, if it is determined that the execution conditions of inter-color adjustment are established (S3: YES), as described below, the CPU 51 performs light amount adjustment processing, inter-light source adjustment processing, inter-color adjustment processing, and density adjustment processing.

Figure 5:
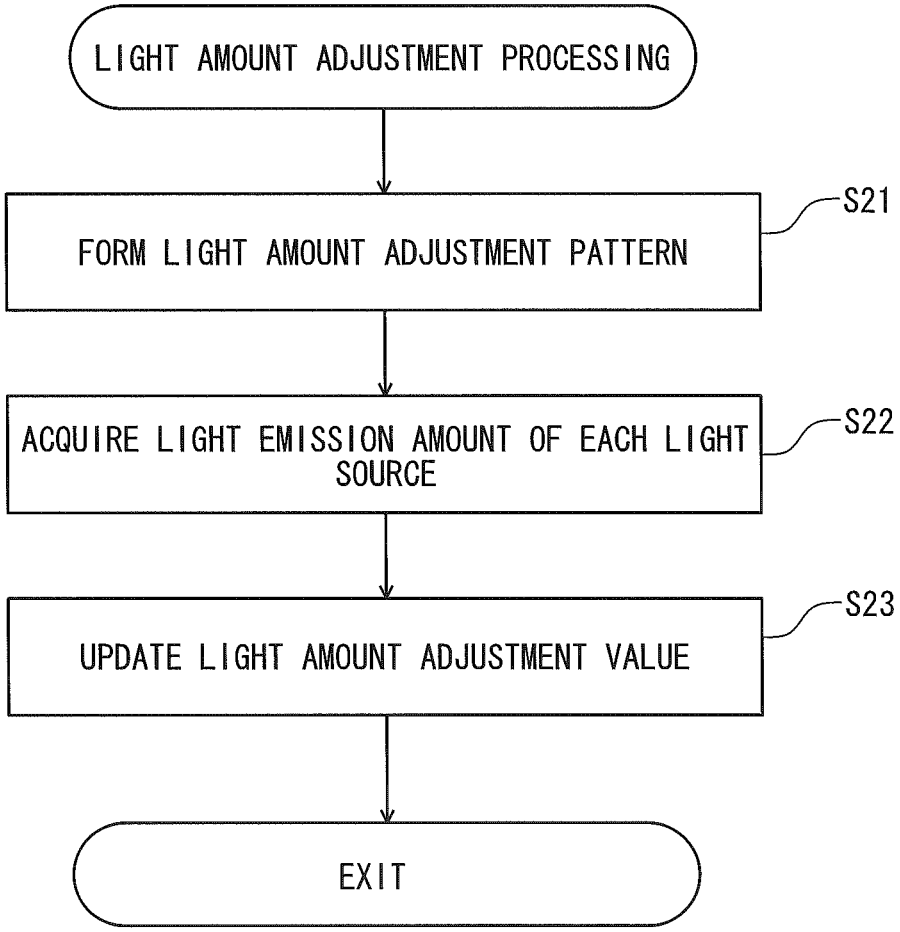
FIG. 5 is a flowchart showing light amount adjustment processing.

Initially, the CPU 51 executes the light amount adjustment processing shown in FIG. 5 (S4). In S21 of FIG. 5, the CPU 51 controls the driving unit 4A to rotate the photosensitive drum 42, the conveying mechanism 4, and the like, and causes the image forming unit 3 to form a light amount adjustment pattern P1 on the belt 23. Specifically, the CPU 51 reads the last light amount adjustment value, light source adjustment value, inter-color adjustment value, bias adjustment value, and gradation adjustment value stored in the nonvolatile memory 54, adjusts image forming conditions, such as the light emission amounts of the light sources 32 and 33, based on these adjustment values, and then causes the image forming unit 3 to form the light amount adjustment pattern P1. In S21, the rotation speed of the photosensitive drum 42, the conveying speed of the conveying mechanism 4, or the like is faster than half the speed during printing processing on the sheet W described below (S10 of FIG. 4), and hereinafter, it is assumed that the rotation speed of the photosensitive drum 42 and the conveying speed of the conveying mechanism 4 is equal to the speed during printing processing on the sheet W or the like.

As shown in FIG. 9, the light amount adjustment pattern P1 is a mark group in which a first light amount mark 61K and a second light amount mark 62K of black, a first light amount mark 61Y and a second light amount mark 62Y of yellow, a first light amount mark 61M and a second light amount mark 62M of magenta, and a first light amount mark 61C and a second light amount mark 62C of cyan are arranged in the sub scanning direction.

The first light amount mark 61 is a mark for acquiring the light emission amount of the first light source 32, has a plurality of first toner lines LD1 formed at an interval in the sub scanning direction, and has a shape in which the second toner lines LD2 are not formed between the first toner lines LD1. The second light amount mark 62 is a mark for acquiring the light emission amount of the second light source 33, has a plurality of second toner lines LD2 formed at an interval in the sub scanning direction, and has a shape in which the first toner lines LD1 are not formed between the second toner lines LD2.

The exposure unit 30 turns off the second light source 33 and forms the electrostatic latent image of the first light amount mark 61 on the photosensitive drum 42 of each color by one light beam L1 emitted from the first light source 32. The exposure unit 30 turns off the first light source 32 and forms the electrostatic latent image of the second light amount mark 62 on the photosensitive drum 42 of each color by one light beam L2 emitted from the second light source 33.

After the light amount adjustment pattern P1 starts to be formed, the CPU 51 acquires the light emission amounts of the first light source 32 and the second light source 33 based on the level of the detection signal output from the mark sensor 6 according to the reflected light amount from the light amount marks 61 and 62 for each color (S22). If the light emission amounts are acquired, the CPU 51 calculates a light amount adjustment value so as to eliminate the difference between the light emission amount of the first light source 32 and the light emission amount of the second light source 33 for each color, updates the light amount adjustment value of each color stored in the nonvolatile memory 54 to the calculated value (S23), and progresses to S5 of FIG. 4.

Figure 6:
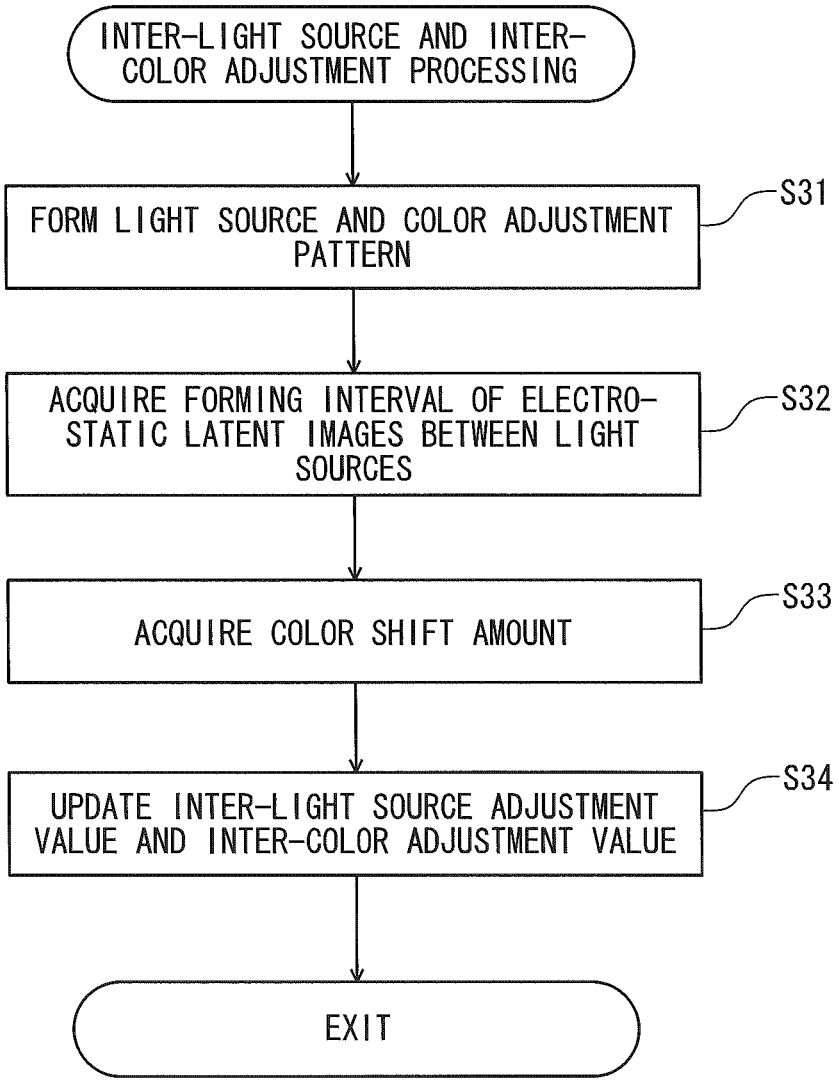
FIG. 6 is a flowchart showing inter-light source and inter-color adjustment processing.

In S5 of FIG. 4, the CPU 51 executes the inter-light source and inter-color adjustment processing shown in FIG. 6. In S31 of FIG. 6, the CPU 51 controls the driving unit 4A to rotate the photosensitive drum 42 and the like, and causes the image forming unit 3 to form a light source and color adjustment pattern P2 on the belt 23. Specifically, the CPU 51 adjusts the image forming conditions based on the last adjustment values stored in the nonvolatile memory 54, and then causes the image forming unit 3 to form the light source and color adjustment pattern P2. In S31, the rotation speed of the photosensitive drum 42 or the like is faster than half the speed during the printing processing on the sheet W described below (S10 of FIG. 4), and hereinafter, it is assumed that the rotation speed of the photosensitive drum 42 or the like is equal to the speed during the printing processing on the sheet W or the like.

As shown in FIG. 10, the light source and color adjustment pattern P2 has a configuration in which an inter-light source adjustment pattern P21 and an inter-color adjustment pattern P22 are arranged in the sub scanning direction. The inter-light source adjustment pattern P21 is a mark group in which a first inter-light source adjustment mark 71K and a second inter-light source adjustment mark 72K of black, a first inter-light source adjustment mark 71Y and a second inter-light source adjustment mark 72Y of yellow, a first inter-light source adjustment mark 71M and a second inter-light source adjustment mark 72M of magenta, and a first inter-light source adjustment mark 71C and a second inter-light source adjustment mark 72C of cyan are arranged in the sub scanning direction. In FIG. 10, only the inter-light source adjustment marks 71K and 72K of black are shown. Each of the inter-light source adjustment marks 71 and 72 is made of a pair of bar marks, and has a shape in which at least one of the bar marks is inclined at a predetermined angle with respect to the main scanning direction. FIG. 10 illustrates the inter-light source adjustment marks 71 and 72 having a shape in which a pair of bar marks is inclined at the same angle with respect to the main scanning direction.

The first inter-light source adjustment mark 71 is a mark for acquiring the position of the electrostatic latent image formed by the light beam L1 from the first light source 32, and each bar mark has at least the first toner lines LD1 positioned at both ends in the sub scanning direction. Specifically, each bar mark of the first inter-light source adjustment mark 71 has a plurality of first toner lines LD1 at an interval in the sub scanning direction, and has a shape in which the second toner lines LD2 are not formed between the first toner lines LD1. The second inter-light source adjustment mark 72 is a mark for acquiring the position of the electrostatic latent image formed by the light beam L2 from the second light source 33, and each bar mark has at least the second toner lines LD2 positioned at both ends in the sub scanning direction. Specifically, each bar mark of the second inter-light source adjustment mark 72 has a plurality of second toner lines LD2 at an interval in the sub scanning direction, and has a shape in which the first toner lines LD1 are not formed between the second toner lines LD2.

The inter-color adjustment pattern P22 has a configuration in which a plurality of mark groups with an inter-color adjustment mark 81Y of yellow, an inter-color adjustment mark 81M of magenta, and an inter-color adjustment mark 81C of cyan arranged in the sub scanning direction are arranged in the sub scanning direction, and includes no inter-color adjustment mark 81K of the reference color. FIG. 10 shows only one set of inter-color adjustment marks 81Y and 81M of yellow and magenta.

Each inter-color adjustment mark 81 is made of a pair of bar marks, and has a shape in which at least one of the bar marks is inclined at a predetermined angle with respect to the main scanning direction. FIG. 10 illustrates the inter-color adjustment mark 81 having a shape in which a pair of bar marks is inclined at the same angle with respect to the main scanning direction. The exposure unit 30 forms the electrostatic latent image of the inter-color adjustment mark 81 on the photosensitive drum 42 by the two light beams L1 and L2 respectively emitted from the first light source 32 and the second light source 33 for each color.

After the light source and color adjustment pattern P2 starts to be formed, the CPU 51 acquires the electrostatic latent image forming interval between the first light source 32 and the second light source 33 based on the level of the detection signal according to both ends of each of the inter-light source adjustment marks 71 and 72 in the sub scanning direction for each color output from the mark sensor 6 (S32). Specifically, as shown in FIG. 10, the level of the detection signal from the mark sensor 6 falls below a threshold value TH when one end of each of the bar marks of the marks 71 and 72 in the sub scanning direction passes through a detection area E and exceeds the threshold value TH when the other end of the bar mark in the sub scanning direction passes through the detection area E. The CPU 51 detects, as the position of the bar mark, a central position X3 of a position X1 corresponding to the timing when the level of the detection signal from the mark sensor 6 falls below the threshold value TH and a position X2 corresponding to the timing when the level of the detection signal from the mark sensor 6 exceeds the threshold value TH.

The CPU 51 sets a central position X4 of the position X3 of one bar mark and the position X3 of the other bar mark as the position of each of the inter-light source adjustment marks 71 and 72 in the sub scanning direction for each of the inter-light source adjustment marks 71 and 72 for each color and calculates the interval D1 between both inter-light source adjustment marks 71 and 72 in the sub scanning direction. The interval D1 changes according to the electrostatic latent image forming interval between the light sources in the sub scanning direction. For this reason, the CPU 51 can acquire the electrostatic latent image forming interval between the light sources in the sub scanning direction based on the interval D1 for each color.

The CPU 51 calculates the interval D2 between the position X3 of one bar mark and the position X3 of the other bar mark for each of the inter-light source adjustment marks 71 and 72 for each color and calculates the difference in the interval D2 between both marks 71 and 72. The difference in the interval D2 changes according to the electrostatic latent image forming interval between the light sources in the main scanning direction. For this reason, the CPU 51 can acquire the electrostatic latent image forming interval between the light sources in the main scanning direction based on the difference in the interval D2 for each color.

The CPU 51 acquires a color shift amount based on the level of the detection signal according to both ends of the inter-color adjustment mark 81 in the sub scanning direction output from the mark sensor 6 for each adjustment color (S33). Specifically, as shown in FIG. 10, the level of the detection signal from the mark sensor 6 falls below the threshold value TH when one end of the bar mark in the sub scanning direction passes through the detection area E and exceeds the threshold value TH when the other end of the bar mark in the sub scanning direction passes through the detection area E. The CPU 51 detects, as the position of the bar mark, a central position X7 of a position X5 corresponding to the timing when the level of the detection signal from the mark sensor 6 falls below the threshold value TH and a position X6 corresponding to the timing when the level of the detection signal from the mark sensor 6 exceeds the threshold value TH.

The CPU 51 sets a central position X0 of the position X4 of the inter-light source adjustment marks 71K and 72K of black in the sub scanning direction as the position of the reference color in the sub scanning direction. The CPU 51 sets a central position X8 of the position X7 of one bar mark and the position X7 of the other bar mark as the position of the inter-color adjustment mark 81 in the sub scanning direction for the inter-color adjustment mark 81 of each adjustment color. The CPU 51 calculates the interval D3 between the position X0 of the reference color in the sub scanning direction and the position X8 of each of the inter-color adjustment marks 81Y, 81M, and 81C of the respective adjustment colors in the sub scanning direction. The interval D3 changes according to a color shift amount of the adjustment color in the sub scanning direction with respect to the reference color. For this reason, the CPU 51 can acquire the color shift amount in the sub scanning direction based on the difference with respect to an ideal interval D3 specified for each adjustment color.

The CPU 51 calculates the interval D4 between the position X7 of one bar mark of the inter-color adjustment mark 81 and the position X7 of the other bar mark. The CPU 51 calculates the average value of the intervals D2 of the inter-light source adjustment marks 71K and 72K of the reference color and the difference in the interval D4 of each of the inter-color adjustment marks 81Y, 81M, and 81C of the respective adjustment colors. The difference in the interval D4 changes according to the color shift amount of each adjustment color in the main scanning direction with respect to the reference color. For this reason, the CPU 51 can acquire the color shift amount in the main scanning direction based on the difference in the interval D4 for each adjustment color.

In this way, in the inter-color adjustment processing, at least a part of the inter-color adjustment marks 81 is not formed, and the inter-light source adjustment marks 71 and 72 are used as the inter-color adjustment marks 81. With this, in the inter-color adjustment processing, it is possible to reduce the number of marks to be formed compared to a configuration in which the inter-light source adjustment marks 71 and 72 are not used as the inter-color adjustment marks 81 and only the inter-color adjustment marks 81 are used.

If the electrostatic latent image forming interval between the light sources is acquired, the CPU 51 calculates a light source adjustment value so as to allow the electrostatic latent image forming interval between the light sources to become a specified interval for each color and updates the light source adjustment value of each color stored in the nonvolatile memory 54 to the calculated value (S34). If the color shift amount is acquired, the CPU 51 calculates an inter-color adjustment value so as to eliminate the color shift amount for each adjustment color, updates the inter-color adjustment value of each adjustment color stored in the nonvolatile memory 54 to the calculated value (S34), and progresses to S8 of FIG. 4.

In S3 of FIG. 4, if it is determined that the execution conditions of inter-color adjustment are not established (S3: NO), the CPU 51 performs the light amount adjustment processing shown in FIG. 5 (S6), and thereafter, performs the inter-light source adjustment processing shown in FIG. 7 (S7).

Figure 7:
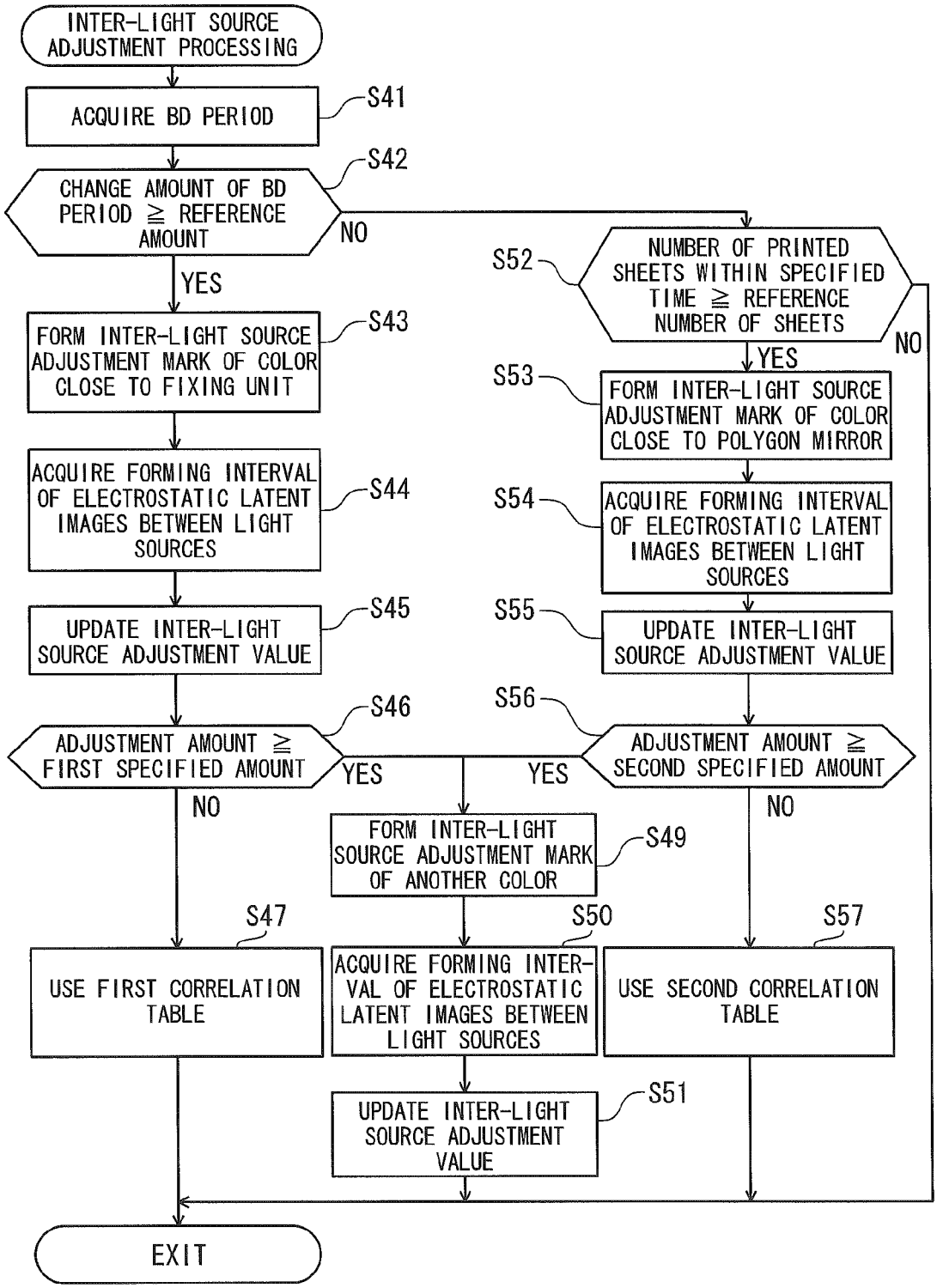
FIG. 7 is a flowchart showing inter-light source adjustment processing.

In S41 of FIG. 7, the CPU 51 acquires a BD period based on BD signals from the BD sensors 38. The BD period is, for example, the time difference between the output timings of the BD signals from the BD sensors 38 provided corresponding to the photosensitive drums 42 of at least two colors. For example, the optical system of the exposure unit 30 is displaced or distorted due to heat from the fixing unit 5, thereby causing fluctuation in the electrostatic latent image forming interval between the light sources. The BD period changes depending on the displacement or the like of the optical system.

Accordingly, it is possible to predict the degree of influence on the electrostatic latent image forming interval between the light sources due to heat from the fixing unit 5 from the change amount of the BD period. If the BD signals from the BD sensors 38 provided corresponding to the photosensitive drum 42K closest to the fixing unit 5 and the photosensitive drum 42C farthest from the fixing unit 5 are used, the displacement or the like of the optical system is noticeably reflected in the BD period. For this reason, it is possible to predict the degree of influence on the electrostatic latent image forming interval between the light sources due to heat from the fixing unit 5 with high accuracy.

Accordingly, the CPU 51 determines whether or not the acquired change amount of the BD period is equal to or larger than a reference amount (S42), and predicts the degree of influence on the electrostatic latent image forming interval between the light sources due to heat generation of the fixing unit 5. The processing of S41 and S42 is an example of influence determination processing. The change amount of the BD period is the difference between the acquired BD period and a reference BD period when the temperature in the body case 1A is a reference temperature, for example, a normal temperature. If it is determined that the change amount of the BD period is equal to or larger than the reference amount (S42: YES), the CPU 51 sets, as a target color, a color corresponding to the light sources 32 and 33 or the optical system arranged closest to the fixing unit 5 and forms only the inter-light source adjustment marks 71 and 72 of the target color on the belt 23 (S43). As shown in FIG. 1, in the printer 1, the target color is cyan.

After the inter-light source adjustment marks 71 and 72 of the target color start to be formed, the CPU 51 acquires the electrostatic latent image forming interval between the first light source 32 and the second light source 33 based on the level of the detection signal according to both ends of each of the inter-light source adjustment marks 71 and 72 in the sub scanning direction of the target color output from the mark sensor 6 for the target color (S44). Next, the CPU 51 calculates a light source adjustment value so as to allow the electrostatic latent image forming interval between the light sources to become a specified interval for the target color, updates the light source adjustment value of the target color stored in the nonvolatile memory 54 to the calculated value (S45), and progresses to S46.

In S46, the CPU 51 determines whether or not the adjustment amount of the electrostatic latent image forming interval between the light sources is equal to or larger than a first specified amount based on the light source adjustment value of the target color calculated in S45. The adjustment amount may be, for example, the light source adjustment value as it is, or may be the difference between the previous and present light source adjustment values. If it is determined that the adjustment amount is not equal to or larger than the first specified amount (S46: NO), the CPU 51 corrects the light source adjustment values of colors other than the target color using the light source adjustment value of the target color and first correlation table stored in advance in the nonvolatile memory 54 (S47), and progresses to S8 of FIG. 4.

The first correlation table is a table which represents the correlation between the light source adjustment value of the target color and the light source adjustment values of other colors, and for example, is created by experimentally obtaining the light source adjustment value of the target color and the light source adjustment values of other colors when the heat generation amount of the fixing unit 5 changes. In the first correlation table, for a color corresponding to the light sources 32 and 33 or the like arranged far from the fixing unit 5, the light source adjustment value decreases. Through the processing of S47, the forming of the inter-light source adjustment marks 71 and 72, or the like is not performed for other colors. For this reason, it is possible to reduce a processing load or processing time for executing the inter-light source adjustment processing.

In S46, if it is determined that the adjustment amount is equal to or larger than the first specified amount (S46: YES), the CPU 51 forms the inter-light source adjustment marks 71 and 72 on the belt 23 for other colors (S49). After the inter-light source adjustment marks 71 and 72 start to be formed, the CPU 51 acquires the electrostatic latent image forming interval between the first light source 32 and the second light source 33 for other colors (S50), calculates a light source adjustment value so as to allow the electrostatic latent image forming interval between the light sources to become a specified interval, updates the light source adjustment value of cyan stored in the nonvolatile memory 54 to the calculated value (S51), and progresses to S8 of FIG. 4.

When the adjustment amount is comparatively large, there is a high possibility that fluctuation in the electrostatic latent image forming interval between the light sources for other colors is shifted from first correlation data. For this reason, the processing of S49 to S51 is executed for other colors, whereby it is possible to suppress the inter-light source adjustment values of other colors from being updated to values incapable of adjusting the electrostatic latent image forming interval between the light sources with high accuracy.

The processing of S49 to S51 is executed for other colors under the condition that the adjustment amount of the electrostatic latent image forming interval between the light sources is equal to or larger than the first specified amount for the target color. For this reason, even though the adjustment amount of a color for which the forming position of the electrostatic latent image between the light sources is likely to fluctuate due to heat from the fixing unit 5 is comparatively small, it is possible to suppress the inter-light source adjustment processing from being wastefully executed for other colors for which the forming position of the electrostatic latent image between the light sources is unlikely to fluctuate due to heat from the fixing unit 5.

In S42, if it is determined that the change amount of the BD period is not equal to or larger than the reference amount (S42: NO), the CPU 51 determines whether or not the number of printed sheets within a specified time is equal to or larger than a reference number of sheets (S52). The optical system of the exposure unit 30 is displaced or distorted due to heat caused by the rotation of the polygon mirror 34, and then, the electrostatic latent image forming interval between the light sources may fluctuate, and the fluctuation may not be reflected in the BD period.

For example, when the fixing unit 5 and the polygon mirror 34 are activated from a state where the printer 1 is cooled down, it takes a long time until the fixing unit 5 generates heat. Meanwhile, the polygon mirror 34 rotates at high speed in a short time and thus generates heat early, and is arranged at a position comparatively closer to the light sources 32 and 33 in the exposure unit 30. For this reason, while it is unlikely to be reflected in the BD period, the electrostatic latent image forming interval between the light sources may fluctuate due to heat from the polygon mirror 34. The greater the number of printed sheets within the specified time, the greater the heat generation amount due to the rotation of the polygon mirror 34. For this reason, it is possible to predict the degree of influence on the electrostatic latent image forming interval between the light sources due to heat from the polygon mirror 34 from the number of printed sheets within the specified time.

In S52, if it is determined that the number of printed sheets within the specified time is not equal to or larger than the reference number of sheets (S52: NO), the CPU 51 progresses to S8 of FIG. 4. In S52, if it is determined that the number of printed sheets within the specified time is equal to or larger than the reference number of sheets (S52: YES), the CPU 51 sets, as the target color, a color corresponding to the light sources 32 and 33 or the like arranged closest to the polygon mirror 34, and forms only the inter-light source adjustment marks 71 and 72 of the target color on the belt 23 (S53). In the printer 1, the polygon mirror 34 is substantially arranged at the center of the exposure unit 30, and the target color is yellow or magenta.

After the inter-light source adjustment marks 71 and 72 start to be formed, the CPU 51 acquires the electrostatic latent image forming interval between the first light source 32 and the second light source 33 for the target color (S54), calculates a light source adjustment value so as to allow the electrostatic latent image forming interval between the light sources to become a specified interval, updates the light source adjustment value of the target color stored in the nonvolatile memory 54 to the calculated value (S55), and progresses to S56.

In S56, the CPU 51 determines whether or not the adjustment amount of the electrostatic latent image forming interval between the light sources is equal to or larger than a second specified amount based on the light source adjustment value of the target color calculated in S55. The adjustment amount may be, for example, the light source adjustment value as it is, or may be the difference between the previous and present light source adjustment values. If it is determined that the adjustment amount is not equal to or larger than the second specified amount (S56: NO), the CPU 51 corrects the light source adjustment values of colors other than the target color using the light source adjustment value of the target color and a second correlation table stored in advance in the nonvolatile memory 54 (S57), and progresses to S8 of FIG. 4.

The second correlation table is a table which represents the correlation between the light source adjustment value of the target color and the light source adjustment values of other colors, and for example, is created by experimentally obtaining the light source adjustment value of the target color and the light source adjustment values of other colors when the polygon mirror 34 is rotated. In the second correlation table, for a color corresponding to the light sources 32 and 33 or the like far from the polygon mirror 34, the light source adjustment value decreases.

In S56, if it is determined that the adjustment amount is equal to or larger than the second specified amount (S56: YES), the CPU 51 progresses to S49. In this way, the processing of S49 to S51 is executed for other colors under the condition that the adjustment amount of the electrostatic latent image forming interval between the light sources is equal to or larger than the second specified amount for the target color. For this reason, even though the adjustment amount of a color for which the forming position of the electrostatic latent image between the light sources is likely to fluctuate due to heat from the polygon mirror 34 is comparatively small, it is possible to suppress the inter-light source adjustment processing from being wastefully executed for other colors for which the forming position of the electrostatic latent image between the light sources is unlikely to fluctuate due to heat from the polygon mirror 34.

As described above, in the inter-light source adjustment processing, through the determination of S42 or S52, the target color for which inter-light source adjustment is initially performed is determined according to the magnitude of the degree of influence on the electrostatic latent image forming interval between the light sources due to heat from the fixing unit 5 or the polygon mirror 34 (S43 or S53). For this reason, it is possible to appropriately determine the target color according to the degree of influence. The processing of S43 or S53 is an example of target determination processing. In S52, if it is determined that the number of printed sheets within the specified time is not equal to or larger than the reference number of sheets (S52: NO), the CPU 51 does not perform inter-light source adjustment, and progresses to S8 of FIG. 4.

Figure 8:
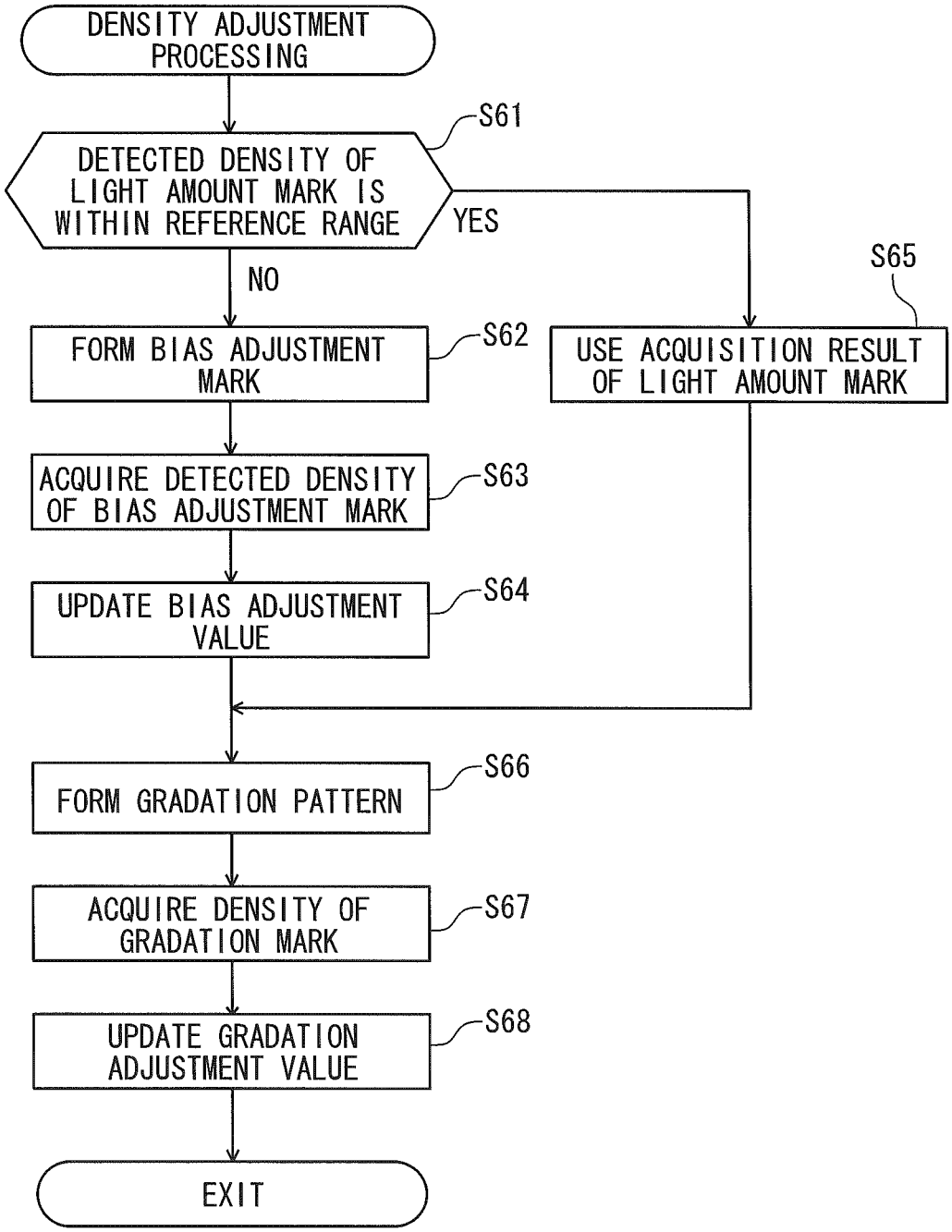
FIG. 8 is a flowchart showing density adjustment processing.

In S8 of FIG. 4, the CPU 51 executes the density adjustment processing shown in FIG. 8. The CPU 51 first executes the bias adjustment processing. In S22 of the light amount adjustment processing of FIG. 5, the detection signal output from the mark sensor 6 has a signal level according to the reflected light amount from the light amount marks 61 and 62, and the reflected light amount changes according to the density of each of the light amount marks 61 and 62. Accordingly, it is possible to acquire the density of each of the light amount marks 61 and 62 from the detection signal from the mark sensor 6 of S22. The light amount marks 61 and 62 can be regarded as marks with density of 50%.

In addition, the detected density of the light amount marks 61 and 62 acquired based on the detection signal from the mark sensor 6 has small fluctuation before and after the execution of the inter-light source adjustment processing compared to a bias adjustment mark 91 shown in FIG. 11. For this reason, even if the detected density of the light amount marks 61 and 62 before the execution of the inter-light source adjustment processing is used in the bias adjustment processing after the execution of the inter-light source adjustment processing, there is little influence of fluctuation in the electrostatic latent image forming interval between the light sources. The reason is as follows.

As described above, the light amount marks 61 and 62 have a shape in which a plurality of first toner lines LD1 or second toner lines are formed at an interval in the sub scanning direction. For this reason, as will be apparent from FIG. 9, even if the electrostatic latent image forming interval between the light sources in the main scanning direction is changed by adjustment, the density of a portion passing through the detection area E out of the light amount marks 61 and 62 is not changed. That is, the detected density of the light amount marks 61 and 62 substantially becomes 50% even before and after the execution of the inter-light source adjustment processing and has small fluctuation.

As shown in FIG. 11, a bias adjustment mark 91 has a known shape which is formed by a dither matrix method. A bias adjustment mark 91A on the right side of FIG. 11 is in a state where the electrostatic latent image forming interval between the light sources in the main scanning direction fluctuates. Specifically, the first toner lines LD1 and the second toner lines LD2 are shifted in the main scanning direction. In this case, in a portion passing through the detection area E out of the bias adjustment mark 91A, since an area where toner is stuck (a hatched portion of FIG. 11) is larger than an area where toner is not stuck (a white portion of FIG. 11), the detected density of the bias adjustment mark 91 exceeds 50%.

A bias adjustment mark 91B on the left side of FIG. 11 is in a state after the execution of the inter-light source adjustment processing, and the first toner lines LD1 and the second toner lines LD2 are not shifted in the main scanning direction. In this case, in a portion passing through the detection area E out of the bias adjustment mark 91B, since an area where toner is stuck is equal to an area where toner is not stuck, the detected density of the bias adjustment mark 91B becomes 50%. That is, the detected density of the bias adjustment mark 91 has great fluctuation before and after the execution of the inter-light source adjustment processing compared to the light amount marks 61 and 62.

Accordingly, in S61 of FIG. 8, the CPU 51 detects the density of a light amount mark based on the signal level of the detection signal from the mark sensor 6 acquired in the light amount adjustment processing (S22 of FIG. 5) for each color, and determines whether or not the detected density is within a reference range. The detected density of the light amount mark may be the density of one of the light amount marks 61 and 62 or may be the average value of the density of both light amount marks 61 and 62. For example, if the difference between the detected density and the ideal density is equal to or less than a specified difference, the CPU 51 may determine that the detected density is within the reference range.

If it is determined that the detected density of the light amount mark is within the reference range (S61: YES), the CPU 51 adjusts a developing bias value using the detected density (S65). Specifically, the CPU 51 compares the detected density and the ideal density for each color, calculates the developing bias value so as to eliminate the difference, updates the bias adjustment value of each color stored in the nonvolatile memory 54 to the calculated value, and progresses to S66 of FIG. 4. With this, since the marks only for the bias adjustment processing are formed, it is possible to reduce the number of marks to be formed.

If it is determined that the detected density of the light amount mark is out of the reference range (S61: NO), the CPU 51 adjusts the image forming conditions based on the last adjustment values stored in the nonvolatile memory 54, and then, causes the image forming unit 3 to form the bias adjustment mark 91 of each color on the belt 23 (S62). The bias adjustment mark 91 is an example of a density mark.

After the bias adjustment mark 91 starts to be formed, the CPU 51 acquires the detected density of the bias adjustment mark 91 based on the level of the detection signal according to the density of the bias adjustment mark 91 output from the mark sensor 6 for each color (S63). Thereafter, the CPU 51 calculates the developing bias value so as to eliminate the difference between the detected density and the ideal density for each color, updates the bias adjustment value of each color stored in the nonvolatile memory 54 to the calculated value (S64), and progresses to S66 of FIG. 4.

In this way, when the detected density of the light amount mark is out of the reference range, in the processing of S65, it may not be possible to accurately adjust the developing bias value. Accordingly, the bias adjustment processing is performed based on the bias adjustment mark 91 again after the inter-light source adjustment processing (S62 to S64), whereby it is possible to accurately adjust the developing bias value.

Figure 12:
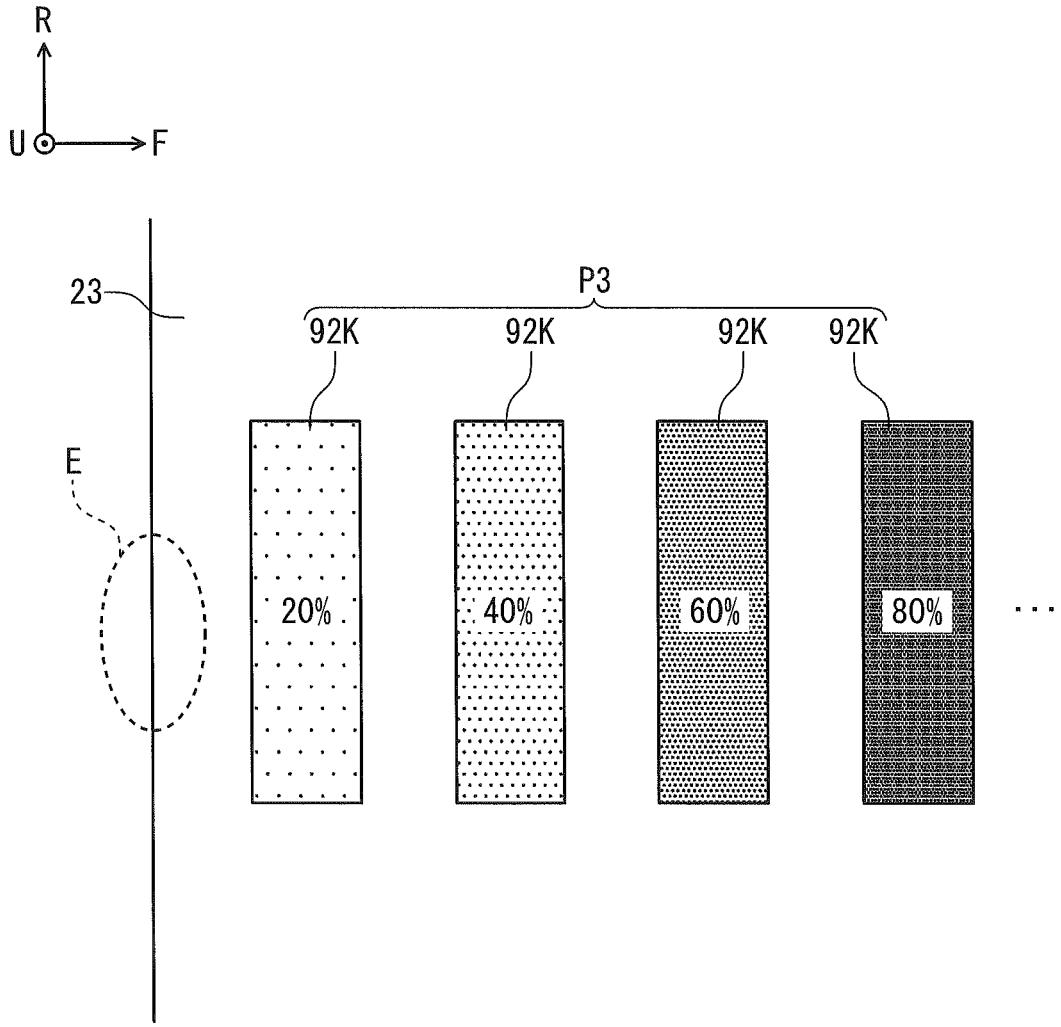
FIG. 12 is a diagram showing an example of a gradation pattern.

The CPU 51 executes the gradation adjustment processing after the execution of the bias adjustment processing. In S66, the CPU 51 adjusts the image forming conditions based on the last adjustment values stored in the nonvolatile memory 54, and then, causes the image forming unit 3 to form a gradation pattern P3 on the belt 23. As shown in FIG. 12, the gradation pattern P3 is a mark group in which a plurality of gradation marks 92 different in density are arranged in the sub scanning direction for each color. The gradation marks 92 are an example of density marks, and in FIG. 12, a part of gradation marks 92K of black is shown.

After the gradation pattern P3 starts to be formed, the CPU 51 acquires the detected density of the gradation marks 92 based on the level of the detection signal according to the density of the gradation marks 92 output from the mark sensor 6 for each color (S67). Thereafter, the CPU 51 calculates a gradation adjustment value so as to allow the gradation based on the detected density to become an ideal gradation for each color, updates the gradation adjustment value of each color stored in the nonvolatile memory 54 to the calculated value (S68), and progresses to S10 of FIG. 4.

In S2 of FIG. 4, if it is determined that the execution conditions of inter-light source adjustment are not established (S2: NO), the CPU 51 executes adjustment processing for which the execution conditions are established (S9), and progresses to S10.

In S10, the CPU 51 performs the printing processing on the sheet W based on image data of the print instruction, and ends this control processing. Specifically, the CPU 51 adjusts the image forming conditions based on the last adjustment values stored in the nonvolatile memory 54, then, causes the exposure unit 30 to form the electrostatic latent image on the photosensitive drum 42 by the two light beams L1 and L2 respectively emitted from the first light source 32 and the second light source 33 for each color, and causes the developing roller 44 to develop the electrostatic latent image and to transfer the electrostatic latent image to the sheet W.

When the execution conditions of both of inter-light source adjustment and density adjustment are established, if the density adjustment processing is performed, and thereafter, the inter-light source adjustment processing is performed, the adjustment result of the density adjustment processing may fluctuate by the execution of the inter-light source adjustment processing. Meanwhile, according to this embodiment, the inter-light source adjustment processing is performed, and thereafter, the density adjustment processing is performed. With this, it is possible to suppress an influence on the density of an image by the adjustment of the electrostatic latent image forming interval between the light sources.

When the execution conditions of both of light amount adjustment and inter-light source adjustment are established, if the inter-light source adjustment processing is performed, and thereafter, the light amount adjustment processing is performed, the adjustment result of the inter-light source adjustment processing may fluctuate by the execution of the light amount adjustment processing. Meanwhile, according to this embodiment, the light amount adjustment processing is performed, and thereafter, the inter-light source adjustment processing is performed. With this, it is possible to suppress an influence on the adjustment of the position of the electrostatic latent image by the adjustment of the difference in the light amount between the light sources.

In the density adjustment processing, if the gradation adjustment processing is performed, and thereafter, the bias adjustment processing is performed, the adjustment result of the gradation adjustment processing may fluctuate by the execution of the bias adjustment processing. Meanwhile, according to this embodiment, since the bias adjustment processing is executed, and thereafter, the gradation adjustment processing is executed, it is possible to suppress an influence on the gradation adjustment processing by the adjustment of the developing bias.

When the execution conditions of both of inter-light source adjustment and inter-color adjustment are established, if the inter-color adjustment processing is performed, and thereafter, the inter-light source adjustment processing is performed, the adjustment result of the inter-color adjustment processing may fluctuate by the execution of the inter-light source adjustment processing. Meanwhile, according to this embodiment, the inter-light source adjustment processing is performed, and thereafter, the inter-color adjustment processing is performed. With this, it is possible to suppress an influence on the adjustment of the position of the electrostatic latent image between the colors by the adjustment of the electrostatic latent image forming interval between the light sources.

The technique disclosed in the present disclosure is not limited to the embodiment described above and illustrated in the drawings. The following embodiments are also included in the scope of the present disclosure.

An "image forming apparatus" is not limited to a direct transfer tandem type color laser printer, and for example, may be other types of image forming apparatuses, such as an intermediate transfer type and a four-cycle type. The image forming apparatus may be a monochrome-dedicated image forming apparatus as well as a color image forming apparatus. The image forming apparatus may be a single printer, a copying machine, a facsimile machine, or a multi function device.

A "multi-beam scanning unit" has three or more light sources, and may have a configuration in which three or more scanning lines can be formed on a photosensitive member simultaneously by light beams respectively emitted from the three or more light sources. In the foregoing embodiment, although the exposure unit 30 has a configuration in which one polygon mirror 34 is used for the four colors, the polygon mirror 34 may be provided for each color.

A "sensor" is not limited to the mark sensor 6, and for example, may be a sensor which outputs a detection signal according to an electrostatic latent image or a toner image of a mark formed on the photosensitive drum 42.

In S22 of FIG. 5, S32 and S33 in FIG. 6, S44, S50, and S54 in FIG. 7, and S63 and S67 in FIG. 8, the CPU 51 may acquire the position or density of each of the marks 61, 62, 71, 72, 81, 91, and 92 based on the comparison of two threshold values and the signal level using, for example, a hysteresis comparator.

A "controller" has a configuration in which the respective kinds of processing of FIGS. 4 to 8 are executed by the single CPU 51. However, the present disclosure is not limited thereto, and the controller may have a configuration in which the respective kinds of processing of FIG. 4 and the like are executed by a plurality of CPUs, a configuration in which the respective kinds of processing of FIG. 4 and the like are executed only by a dedicated hard circuit, such as the ASIC 55, or a configuration in which the respective kinds of processing of FIG. 4 and the like are executed by a CPU and a hard circuit.

The CPU 51 may not execute at least one of the light amount adjustment processing and the inter-color adjustment processing. The CPU 51 may not execute at least one of the bias adjustment processing and the gradation adjustment processing. The CPU 51 may execute the inter-color adjustment processing after the density adjustment processing or between the bias adjustment processing and the gradation adjustment processing.

The marks 71, 72, and 81 may be bar marks in the sub scanning direction.

In the density adjustment processing of S8 of FIG. 4, the CPU 51 may execute either the bias adjustment processing or the gradation adjustment processing.

The first light amount mark 61 may have a shape in which a plurality of first toner marks LD1 are formed at an interval in the sub scanning direction, and the second light amount mark 62 may have a shape in which a plurality of second toner marks LD2 are formed at an interval in the sub scanning direction. However, in order to form solid light amount marks, since the rotation speed of the photosensitive drum 42 and the conveying speed of the conveying mechanism 4 should be equal to or lower than half the speed during the printing processing on the sheet W (S10 of FIG. 4), the forming time of the light amount adjustment pattern may be extended. Meanwhile, if the light amount marks 61 and 62 have the shape of the foregoing embodiment, since the light amount marks can be formed with the same rotation speed of the photosensitive drum 42 and the like as during the printing processing on the sheet W, it is possible to suppress the extension of the forming time of the light amount marks.

The first light amount mark 61 may have a shape in which the second toner lines LD2 are formed between the first toner lines LD1, and the second light amount mark 62 may have a shape in which the first toner lines LD1 are formed between the second toner lines LD2. In summary, in each light amount mark, it should suffice that the ratio of toner lines corresponding to a light source, the light emission amount of which is acquired by the light amount mark, with respect to the entire mark is higher than the ratio of other toner lines.

In the inter-light source and inter-color adjustment processing of FIG. 6, the CPU 51 may form a pattern where all marks are inter-light source adjustment marks, instead of the light source and color adjustment pattern P2, and may acquire the electrostatic latent image forming interval between the light sources and the color shift amount based on the inter-light source adjustment marks. According to this configuration, since marks having the same shape or forming method are used, it is possible to suppress degradation in adjustment accuracy due to the difference in shape or the like between the marks. According to the configuration of the foregoing embodiment, similarly to the sheet printing processing, since it is possible to form the inter-color adjustment mark 81 by a normal exposure method which performs simultaneous scanning with the two light sources 32 and 33, it is possible to reduce a control load for mark forming, or the like.

The first inter-light source adjustment mark 71 may have a shape in which the second toner lines LD2 are formed between the first toner lines LD1, and the second inter-light source adjustment mark 72 may have a shape in which the first toner lines LD1 are formed between the second toner lines LD2. In summary, it should suffice that each bar mark of each inter-light source adjustment mark has a shape in which toner lines corresponding to a light source, for which the position of the electrostatic latent image is acquired by the mark, are at least formed at both ends in the sub scanning direction.

In the influence determination processing of S41 and S42 of FIG. 7, a temperature sensor which outputs a detection signal according to the temperature of the fixing unit 5 may be provided in the printer 1, and the CPU 51 may predict the degree of influence on the electrostatic latent image forming interval between the light sources due to heat from the fixing unit 5 based on the detection signal from the temperature sensor.

In S46 or S56, if it is determined that the adjustment amount is not equal to or larger than the specified amount (S46: NO or S56: NO), the CPU 51 does not perform the processing of S47, and progresses to S8 of FIG. 4 without correcting the light source adjustment values of other colors.

In the inter-light source adjustment processing of FIG. 7, the CPU 51 may initially form the inter-light source adjustment marks 71 and 72 or the like for other colors, instead of a color corresponding to the light sources 32 and 33 or the like arranged close to the fixing unit 5 or the polygon mirror 34.

In S46 or S56, if it is determined that the adjustment amount is equal to or larger than the specified amount (S46: YES or S56: YES), the CPU 51 may perform the processing of S49 to S51 for a color corresponding to the light sources 32 and 33 or the like arranged next closest to the fixing unit 5 or the polygon mirror 34 and may further perform the processing of S49 to S51 for a color corresponding to the light sources 32 and 33 or the like next closest to the fixing unit 5 or the like under the condition that the adjustment amount of the color is equal to or larger than the specified amount.

In the processing of S52 of FIG. 7, the degree of influence on the electrostatic latent image forming interval between the light sources due to heat from the polygon mirror 34 may be predicted based on the elapsed time from the start of the rotation of the polygon mirror 34, the rotation amount within the specified time, or the like, instead of the number of printed sheets within the specified time. A temperature sensor which outputs a detection signal according to the temperature of the polygon mirror 34 may be provided in the printer 1, and the CPU 51 may predict the degree of influence on the electrostatic latent image forming interval between the light sources due to heat from the polygon mirror 34 based on the detection signal from the temperature sensor.

In the density adjustment processing of FIG. 8, if it is determined that the detected density of the light amount mark is within the reference range, the CPU 51 may progress to S66 without performing the processing of S65, that is, without adjusting the bias value. The CPU 51 may constantly perform the processing of S65 without performing the processing of S61. The CPU 51 may constantly perform the processing of S62 to S64 without performing the processing of S61.

What is claimed is:

1. An image forming apparatus comprising:

at least one photosensitive member;

a forming unit comprising at least one developing unit and a multi-beam scanning unit having a plurality of light sources for each developing unit;

a sensor; and a controller configured to:

execute inter-light source adjustment processing to control the forming unit to form, for each of a plurality of light sources, an inter-light source adjustment mark representing a position of an electrostatic latent image formed on the photosensitive member by a light beam from the light source and to adjust a relative electrostatic latent image forming interval among the light sources based on a signal output from the sensor according to the inter-light source adjustment mark;

execute density adjustment processing to control the forming unit to form a density mark representing the density of an image formed on the photosensitive member by a plurality of light beams from the light sources and to adjust the density of the image based on a signal output from the sensor according to the density mark;

execute condition determination processing to determine whether or not execution conditions of each of the inter-light source adjustment processing and the density adjustment processing are established; and execute order determination processing, when determined in the condition determination processing that the execution conditions of both of the inter-light source adjustment processing and the density adjustment processing are established, to determine an execution order so as to perform the inter-light source adjustment processing and thereafter to perform the density adjustment processing.

2. The image forming apparatus according to claim 1, wherein the controller is configured to:

execute light amount adjustment processing to control the forming unit to form, for each of the light sources, a light amount mark representing the light amount of a light beam from the light source and to adjust a relative difference in light amount among the light sources based on a signal output from the sensor according to the light amount mark;

determine, in the condition determination processing, whether or not the execution conditions of the light amount adjustment processing are established; and determine, in the order determination processing, when determined in the condition determination processing that the execution conditions of both of the light amount adjustment processing and the inter-light source adjustment processing are established, an execution order so as to perform the light amount adjustment processing and thereafter to perform the inter-light source adjustment processing.

3. The image forming apparatus according to claim 1, wherein the density adjustment processing comprises at least one of:

bias adjustment processing for adjusting a developing bias value of the forming unit based on a signal output from the sensor according to the density mark; and gradation adjustment processing for adjusting the gradation of the density of an image based on a signal output from the sensor according to each of a plurality of density marks different in density.

4. The image forming apparatus according to claim 3, wherein the density adjustment processing comprises the bias adjustment processing and the gradation adjustment processing, and wherein the controller performs, in the density adjustment processing, the bias adjustment processing and thereafter performs the gradation adjustment processing.

5. The image forming apparatus according to claim 1, wherein the forming unit comprises a plurality of developing units which accommodate toner of different colors, wherein a plurality of the photosensitive members are provided corresponding to the plurality of developing units, wherein the controller executes inter-color adjustment processing to control the forming unit to form, for each of the plurality of developing units and photosensitive members, an inter-color adjustment mark representing a position of an electrostatic latent image of each color formed on the photosensitive member by a plurality of light beams from the light sources and to adjust relative positions of the electrostatic latent images among the colors based on a signal output from the sensor according to the inter-color adjustment mark, wherein, in the condition determination processing, the controller further determines whether or not the execution conditions of the inter-color adjustment processing are established, and wherein, in the order determination processing, when determined in the condition determination processing that the execution conditions of both of the inter-light source adjustment processing and the inter-color adjustment processing are established, the controller determines an execution order so as to perform the inter-light source adjustment processing and thereafter to perform the inter-color adjustment processing.

6. The image forming apparatus according to claim 1, wherein the forming unit comprises a plurality of developing units which accommodate toner of different colors, wherein a plurality of the photosensitive members are provided corresponding to the plurality of developing units, wherein the controller executes inter-color adjustment processing to control the forming unit to form, for each of the plurality of developing units and photosensitive members, an inter-color adjustment mark representing a position of an electrostatic latent image of each color formed on the photosensitive member by a plurality of light beams from the light sources and to adjust relative positions of the electrostatic latent images among the colors based on a signal output from the sensor according to the inter-color adjustment mark, wherein, in the condition determination processing, the controller determines whether or not the execution conditions of the inter-color adjustment processing are established, and wherein, in the inter-color adjustment processing, when determined in the condition determination processing that the execution conditions of both of the inter-light source adjustment processing and the inter-color adjustment processing are established, the controller controls the forming unit to not form at least a part of the inter-color adjustment marks and adjusts the relative positions of the electrostatic latent images among the colors based on the signal output from the sensor according to the inter-light source adjustment mark formed in the inter-light source adjustment processing.

7. The image forming apparatus according to claim 1, wherein, in the condition determination processing, the controller determines that the execution condition of the density adjustment processing is established when the execution condition of the inter-light source adjustment processing is established, and wherein the controller determines that the execution condition of the inter-light source adjustment processing is established or not established in a case where the execution condition of the density adjustment processing is established.

8. The image forming apparatus according to claim 1, wherein the forming unit comprises:

a plurality of developing units; and a plurality of sets of light sources corresponding to the plurality of developing units, and wherein the controller executes the inter-light source adjustment processing for one set of the plurality of sets of light sources and executes the inter-light source adjustment processing for other sets of light sources under a condition that an adjustment amount in the inter-light source adjustment processing is equal to or larger than a specified amount.

9. The image forming apparatus according to claim 8, wherein the forming unit further comprises a fixing unit, and wherein one set of the light sources is a set, in which a forming position of the electrostatic latent image among the light sources is more likely to fluctuate due to heat from the fixing unit, among the plurality of sets.

10. The image forming apparatus according to claim 8, wherein the multi-beam scanning unit comprises a rotating rotary polygon mirror and is configured to deflect light beams from each of the plurality of sets of light sources by the rotary polygon mirror and to irradiate the photosensitive member with the light beams, and wherein one set of the light sources is a set, in which a forming position of the electrostatic latent image among the light sources is more likely to fluctuate due to heat from the rotary polygon mirror, among the plurality of sets.

11. The image forming apparatus according to claim 8, wherein the forming unit comprises a fixing unit, wherein the multi-beam scanning unit comprises a rotating rotary polygon mirror and is configured to deflect light beams from each of the plurality of sets of light sources by the rotary polygon mirror and to irradiate the photosensitive member with the light beams, and wherein the controller is configured to:

execute influence determination processing to determine whether or not a degree of influence on a forming position of the electrostatic latent image among the light sources due to heat from the fixing unit is equal to or less than a reference degree; and execute target determination processing to determine, when determined in the influence determination processing that the degree of influence due to heat from the fixing unit is equal to or larger than the reference degree, one set of the light sources to a set, in which the forming position of the electrostatic latent image among the light sources is more likely to fluctuate due to heat from the fixing unit, among the plurality of sets, and to determine, when determined that the degree of influence due to heat from the fixing unit is not equal to or larger than the reference degree, one set of the light sources to a set, in which the forming position of the electrostatic latent image among the light sources is more likely to fluctuate due to heat from the rotary polygon mirror, among the plurality of sets.

12. A method for adjusting a forming condition of an image forming apparatus comprising a photosensitive member, a forming unit that comprises at least one developing unit and a multi-beam scanning unit having a plurality of light sources for each developing unit, and a sensor, the method comprising:

an inter-light source adjustment step for controlling the forming unit to form, for each of a plurality of light sources, an inter-light source adjustment mark representing a position of an electrostatic latent image formed on the photosensitive member by a light beam from the light source and adjusting a relative electrostatic latent image forming interval among the light sources based on a signal output from the sensor according to the inter-light source adjustment mark;

a density adjustment step for controlling the forming unit to form a density mark representing the density of an image formed on the photosensitive member by a plurality of light beams from the light sources and adjusting the density of the image based on a signal output from the sensor according to the density mark;

a condition determination step for determining whether or not execution conditions of each of the inter-light source adjustment step and the density adjustment step are established; and an order determination step, when determined in the condition determination step that the execution conditions of both of the inter-light source adjustment step and the density adjustment step are established, for determining an execution order so as to perform the inter-light source adjustment step and thereafter to perform the density adjustment step.

13. The method according to claim 12 further comprising:

executing a light amount adjustment step to control the forming unit to form, for each of the light sources, a light amount mark representing the light amount of a light beam from the light source and to adjust a relative difference in light amount among the light sources based on a signal output from the sensor according to the light amount mark;

determine, in the condition determination step, whether or not the execution conditions of the light amount adjustment step are established; and determine, in the order determination step, when determined in the condition determination step that the execution conditions of both of the light amount adjustment step and the inter-light source adjustment step are established, an execution order so as to perform the light amount adjustment step and thereafter to perform the inter-light source adjustment step.

14. The method according to claim 12, wherein the density adjustment step comprises at least one of:

bias adjustment processing for adjusting a developing bias value of the forming unit based on a signal output from the sensor according to the density mark; and gradation adjustment processing for adjusting the gradation of the density of an image based on a signal output from the sensor according to each of a plurality of density marks different in density.

15. The method according to claim 14, wherein the density adjustment step comprises the bias adjustment processing and the gradation adjustment processing, and wherein, in the density adjustment step, the bias adjustment processing is performed and thereafter the gradation adjustment processing is performed.

16. The method according to claim 12, wherein the forming unit comprises a plurality of developing units which accommodate toner of different colors, wherein a plurality of the photosensitive members are provided corresponding to the plurality of developing units, wherein the method further comprises:

executing an inter-color adjustment step to control the forming unit to form, for each of the plurality of developing units and photosensitive members, an inter-color adjustment mark representing a position of an electrostatic latent image of each color formed on the photosensitive member by a plurality of light beams from the light sources and to adjust relative positions of the electrostatic latent images among the colors based on a signal output from the sensor according to the inter-color adjustment mark, determining, in the condition determination step, whether or not the execution conditions of the inter-color adjustment step are established, and determining, in the order determination step, an execution order so as to perform the inter-light source adjustment step and thereafter to perform the inter-color adjustment step when determined in the condition determination step that the execution conditions of both of the inter-light source adjustment step and the inter-color adjustment step are established.

17. A non-transitory computer-readable storage medium storing instruction to control an image forming apparatus, the image forming apparatus comprising at least one photosensitive member, a forming unit comprising at least one developing unit and a multi-beam scanning unit having a plurality of light sources for each developing unit, a sensor, and a controller, the instructions, when executed, causing the image forming apparatus to perform:

an inter-light source adjustment processing for controlling the forming unit to form, for each of a plurality of light sources, an inter-light source adjustment mark representing a position of an electrostatic latent image formed on the photosensitive member by a light beam from the light source and adjusting a relative electrostatic latent image forming interval among the light sources based on a signal output from the sensor according to the inter-light source adjustment mark;

a density adjustment processing for controlling the forming unit to form a density mark representing the density of an image formed on the photosensitive member by a plurality of light beams from the light sources and adjusting the density of the image based on a signal output from the sensor according to the density mark;

a condition determination processing for determining whether or not execution conditions of each of the inter-light source adjustment processing and the density adjustment processing are established; and an order determination processing, when determined in the condition determination processing that the execution conditions of both of the inter-light source adjustment processing and the density adjustment processing are established, for determining an execution order so as to perform the inter-light source adjustment processing and thereafter to perform the density adjustment processing.

18. The non-transitory computer-readable storage medium according to claim 17, wherein the instructions further cause the image forming apparatus to perform:

a light amount adjustment processing for controlling the forming unit to form, for each of the light sources, a light amount mark representing the light amount of a light beam from the light source and to adjust a relative difference in light amount among the light sources based on a signal output from the sensor according to the light amount mark;

an execution condition determination processing for determining, in the condition determination processing, whether or not the execution conditions of the light amount adjustment processing are established; and an execution order determination processing for determining, in the order determination processing, when determined in the condition determination processing that the execution conditions of both of the light amount adjustment processing and the inter-light source adjustment processing are established, an execution order so as to perform the light amount adjustment processing and thereafter to perform the inter-light source adjustment processing.

19. The non-transitory computer-readable storage medium according to claim 17, wherein the density adjustment processing comprises at least one of:

bias adjustment processing for adjusting a developing bias value of the forming unit based on a signal output from the sensor according to the density mark; and gradation adjustment processing for adjusting the gradation of the density of an image based on a signal output from the sensor according to each of a plurality of density marks different in density.

20. The non-transitory computer-readable storage medium according to claim 19, wherein the density adjustment processing comprises the bias adjustment processing and the gradation adjustment processing, and wherein, in the density adjustment processing, the bias adjustment processing is performed and thereafter the gradation adjustment processing is performed.

* * * * *